US012752326B2

(12) United States Patent
Kitagoh

(10) Patent No.: US 12,752,326 B2
(45) Date of Patent: Oct. 6, 2026

(54) TEMPERATURE CONTROL SYSTEM AND TEMPERATURE CONTROL METHOD FOR HOT ROLLING LINE

(71) Applicant: TMEIC CORPORATION, Tokyo (JP)

(72) Inventor: Kazutoshi Kitagoh, Tokyo (JP)

(73) Assignee: TMEIC CORPORATION, Tokyo (JP)

( * ) Notice: Subject to any disclaimer, the term of this patent is extended or adjusted under 35 U.S.C. 154(b) by 217 days.

(21) Appl. No.: 18/836,838

(22) PCT Filed: Jan. 26, 2023

(86) PCT No.: PCT/JP2023/002456
§ 371 (c)(1),
(2) Date: Aug. 8, 2024

(87) PCT Pub. No.: WO2024/157420
PCT Pub. Date: Aug. 2, 2024

(65) Prior Publication Data
US 2025/0144688 A1 May 8, 2025

(51) Int. Cl.
*B21B 37/74* (2006.01)

(52) U.S. Cl.
CPC ..... *B21B 37/74* (2013.01)

(58) Field of Classification Search
None
See application file for complete search history.

(56) References Cited

U.S. PATENT DOCUMENTS 11,167,331 B2 * 11/2021 Kitagoh ..... B21B 1/22
2014/0138054 A1 * 5/2014 Kobayashi ..... B21B 45/0233 165/104.19
2019/0151918 A1 * 5/2019 Tachibana ..... B21B 45/0233

FOREIGN PATENT DOCUMENTS

CA 2894480 C * 9/2017 ..... B21B 45/0233
DE 102016207692 A1 * 11/2016 ..... B21B 37/74
JP H07-024515 A 1/1995
(Continued)

OTHER PUBLICATIONS

Bo Gong et al. Development of Step Cooling Control System after Rolling Based on Automatic Feedback Control in Hot Strip Mill, 2018 (Year: 2018).*
(Continued)

*Primary Examiner* — Howard Cortes
(74) *Attorney, Agent, or Firm* — XSENSUS LLP

(57) ABSTRACT

A hot rolling line includes a rougher mill, a finisher mill, an intermediate equipment group, a rougher delivery-side pyrometer, a finisher entry-side pyrometer, and a control device. The intermediate equipment group includes a cooling equipment. The control device includes a set-up calculation device configured to determine a flow amount set-up value of the coolant water in the cooling equipment, a feedforward control device configured to perform feedforward control of a flow amount of the coolant water in the cooling equipment based on the flow amount set-up value, and a learning device configured to calculate a learning value based on a flow amount measured value of the coolant water in the cooling equipment and a finisher entry-side temperature measured value indicating a measured value of the material to be rolled measured by the finisher entry-side pyrometer.

10 Claims, 17 Drawing Sheets

(56) References Cited

FOREIGN PATENT DOCUMENTS

| | | | | |
|---|---|---|---|---|
| JP | 2007-050417 | A | | 3/2007 |
| JP | 2008221273 | A | * | 9/2008 |

OTHER PUBLICATIONS

International Search Report and Written Opinion mailed on Apr. 11, 2023, received for PCT Application No. PCT/JP2023/002456, filed on Jan. 26, 2023, 10 pages including partial English Translation.

* cited by examiner

TEMPERATURE CONTROL SYSTEM AND TEMPERATURE CONTROL METHOD FOR HOT ROLLING LINE

CROSS-REFERENCE TO RELATED APPLICATION

This application is a national stage application, pursuant to 35 U.S.C. § 371, of International Patent Application No. PCT/JP2023/002456, filed Jan. 26, 2023, the entire contents of which are incorporated herein by reference.

FIELD

The present disclosure relates to a system and a method for controlling temperature of a material to be rolled in a hot rolling line.

BACKGROUND

A hot rolling line generally includes a rougher mill and a finisher mill. The number of the rougher mill provided in the hot rolling line is at least one. The rougher mill performs a rougher rolling (a reverse rolling) including a forward feeding of the material to be rolled and a backward pulling of the material to be rolled. In the rougher rolling, a thickness of the material to be rolled is reduced to an intermediate bar target value. The finisher mill includes at least two mills installed downstream of the rougher mill. The finisher mill performs a finisher rolling (a tandem rolling) on the material to be rolled. In the finisher rolling, the thickness of the material to be rolled is reduced to a coil thickness target value, which is a target thickness of a product.

Temperature of the material to be rolled during the rougher rolling is about 1000 to 1150° C. The temperature of the material to be rolled decreases during a transfer from the rougher mill to the finisher mill. A timing at which a head end of the material to be rolled reaches the finisher mill is different from a timing at which a tail end reaches the finisher mill. Therefore, the temperature of the material to be rolled generally decreases from a position of the head end toward that of the tail end. When the temperature of the head end is about 1000 to 1100° C., the temperature of the tail end may be lower than that of the head end by 50° C. or more. This phenomenon is called a thermal rundown.

In the related art, in the hot rolling line, the temperature of the material to be rolled on an entry side of the finisher mill (hereinafter, also referred to as a "finisher entry-side temperature") is not particularly controlled. This is because the temperature of the material to be rolled extracted from a heating furnace is set to a sufficiently high temperature such that the temperature of the material to be rolled on a delivery side of the finisher mill (hereinafter, also referred to as a "finisher delivery-side temperature") falls within a certain range and also a rolling from the head end to the tail end is stably performed.

However, in recent years, requirements for a material and quality accuracy of the material to be rolled have become strict, and the finisher entry-side temperature has been often controlled. For example, in a ferritic rolling, the finisher entry-side temperature is controlled to 900° C. or less. In addition, in order to control a grain size of the material to be rolled at the delivery side of the finisher mill, a finisher rolling may be performed in a temperature range from 950 to 1000° C. When a material to be rolled having a size which is difficult to roll, such as an ultrathin material, the finisher rolling may be performed at a temperature as high as possible in order to reduce a rolling load.

Examples of prior arts related to the present disclosure include PLT1. PLT1 discloses a method for controlling a group of nozzles provided between a rougher mill and a finisher mill. In PLT 1, the group of nozzles are arranged in a conveying direction and a width direction of the material to be rolled, and coolant water of the material to be rolled is jetted from the group of nozzles. In the method of PLT1, an operation of the group of nozzles is controlled such that a temperature drop width of the material to be rolled in the width direction falls within a predetermined width. However, there is no detailed description in PLT1 about the control of the temperature of the material to be rolled in the conveying direction (i.e., a longitudinal direction).

The examples of the prior arts related to present disclosure include PLT2. PLT2 discloses a method for controlling a cooling equipment provided between a rougher mill and a finisher mill. In the method of PLT2, a flow amount of coolant water supplied from the cooling equipment to control the finisher entry-side temperature to a target value is calculated using a measured value of a pyrometer provided on an entry side of the cooling equipment (i.e., a delivery side of the rougher mill). However, behavior of water cooling at high temperatures is very complex, since it is influenced by a formation of a boiling film at a boundary between the material to be rolled and water, by a convection of the water, by a turbulence, etc. In addition, cooling characteristics of water cooling including a heat transfer coefficient vary depending on a rolling velocity, a surface state of the material to be rolled, and the like, and it is difficult to predict the cooling characteristics quantitatively. Therefore, there is a problem that a non-negligible difference is inevitably generated between the finisher entry-side temperature and the target value.

CITATION LIST

Patent Literature

[PLT1] JP7-24515A
[PLT2] JP2007-50417A

SUMMARY

Technical Problem

The present disclosure has been made to solve the above problem, and an object of the present disclosure is to provide a technique capable of controlling temperature of a material to be rolled on an entry side of a finisher mill to a desired temperature in a hot rolling line including a rougher mill and the finisher mill.

Solution to Problem

A first aspect of the present disclosure is a system for controlling temperature of a material to be rolled in a hot rolling line and has the following features.

The hot rolling line includes a rougher mill for performing a reverse rolling, a finisher mill for performing a tandem rolling, an intermediate equipment group provided between the rougher mill and the finisher mill, a rougher delivery-side pyrometer provided between the rougher mill and the intermediate equipment group, a finisher entry-side pyrometer provided between the finisher mill and the intermediate equipment group, and a control device.

The intermediate equipment group includes a cooling equipment for cooling the material to be rolled using coolant water.

The control device comprises:

a set-up calculation device configured to determine a flow amount set-up value of the coolant water in the cooling equipment;

a feedforward control device configured to perform feedforward control of the flow amount of the coolant water in the cooling equipment based on the flow amount set-up value; and a learning device configured to calculate a learning value based on a flow amount measured value of the coolant water in the cooling equipment and a finisher entry-side temperature measured value indicating a measured value of temperature of the material to be rolled measured by the finisher entry-side pyrometer.

The set-up calculation device is configured to:

determine a finisher entry-side temperature target value indicating a target value of the temperature of the material to be rolled at an entry side of the finisher mill before a final pass of the reverse rolling on the material to be rolled is performed;

calculate a cooling equipment delivery-side temperature target value indicating a target value of the temperature of the material to be rolled at a delivery side of the cooling equipment for a finisher entry-side temperature prediction value indicating a predicted value of the temperature of the material to be rolled at the entry side of the finisher mill to match the finisher entry-side temperature target value; and determine the flow amount set-up value based on the cooling equipment delivery-side temperature target value and the learning value.

The feedforward control device is configured to:

determine a target temperature pattern indicating a pattern of target values of the temperature of the material to be rolled over whole length of the material to be rolled at the delivery side of the cooling equipment; and calculate flow amount standard values of the coolant water in the cooling equipment for each point in a longitudinal direction of the material to be rolled based on the flow amount set-up value, velocity information of the rougher mill, and a rougher delivery-side temperature measured value indicating a measured value of the temperature of the material to be rolled measured by the rougher delivery-side pyrometer.

The flow amount standard values are calculated such that a temperature prediction value of the delivery side of the cooling equipment indicating a predicted value of the temperature of the material to be rolled at the delivery side of the cooling equipment is consistent with the target temperature pattern.

The feedforward control device is further configured to:

perform the feedforward control such that flow amounts of the coolant water in the cooling equipment when each point of the material to be rolled reaches position to be cooled by the cooling equipment are respectively consistent with the flow amount standard values calculated for each point of the material to be rolled.

The learning device is configured to calculate the learning value based on a difference between the finisher entry-side temperature measured value and a finisher entry-side temperature re-prediction value indicating a re-prediction value of the temperature of the material to be rolled at the entry side of the finisher mill.

The finisher entry-side temperature re-prediction value is calculated based on the flow amount measured value, the rougher delivery-side temperature measured value, and an actual velocity of the material to be rolled.

A second aspect of the present disclosure is a method for controlling the temperature of a material to be rolled in a hot rolling line and has the following features.

The hot rolling line includes a rougher mill for performing a reverse rolling, a finisher mill for performing a tandem rolling, an intermediate equipment group provided between the rougher mill and the finisher mill, a rougher delivery-side pyrometer provided between the rougher mill and the intermediate equipment group, a finisher entry-side pyrometer provided between the finisher mill and the intermediate equipment group, and a control device.

The intermediate equipment group includes a cooling equipment for cooling the material to be rolled using coolant water.

The method comprising the steps of:

determining a flow amount set-up value of the coolant water in the cooling equipment; performing feedforward control of a flow amount of the coolant water in the cooling equipment based on the flow amount set-up value; and calculating a learning value based on a flow amount measured value of the coolant water in the cooling equipment and a finisher entry-side temperature measured value indicating a measured value of temperature of the material to be rolled measured by the finisher entry-side pyrometer.

The step of determining the flow amount set-up value comprises the steps of:

determining a finisher entry-side temperature target value indicating a target value of the temperature of the material to be rolled at an entry side of the finisher mill before a final pass of the reverse rolling on the material to be rolled is performed;

calculating a cooling equipment delivery-side temperature target value indicating a target value of the temperature of the material to be rolled at a delivery side of the cooling equipment for a finisher entry-side temperature prediction value indicating a predicted value of the temperature of the material to be rolled at the entry side of the finisher mill to match the finisher entry-side temperature target value; and determining the flow amount set-up value based on the cooling equipment delivery-side temperature target value and the learning value.

The step of performing the feedforward control comprises the steps of:

determining a target temperature pattern indicating a pattern of target values of the temperature of the material to be rolled over entire length of the material to be rolled at the delivery side of the cooling equipment;

calculating flow amount standard values of the coolant water in the cooling equipment for each point in a longitudinal direction of the material to be rolled based on the flow amount set-up value, velocity information of the rougher mill, and a rougher delivery-side temperature measured value indicating a measured value of the temperature of the material to be rolled measured by the rougher delivery-side pyrometer, wherein the flow amount standard values are calculated such that a cooling equipment delivery-side temperature prediction value indicating a predicted value of the temperature of the material to be rolled at the delivery side of the cooling equipment is consistent with the target temperature pattern; and performing the feedforward control such that flow amounts of the coolant water in the cooling equipment when each point of the material to be rolled reaches position to be cooled by the cooling equipment are respectively consistent with the flow amount standard values calculated for each point of the material to be rolled.

The step of calculating the learning value comprises the steps of:

calculating the learning value based on a difference between the finisher entry-side temperature measured value and a finisher entry-side temperature re-prediction value indicating a re-prediction value of a temperature of the material to be rolled at the entry side of the finisher mill, wherein the finisher entry-side temperature re-prediction value is calculated based on the flow amount measured value, the rougher delivery-side temperature measured value, and an actual velocity of the material to be rolled.

Effects of Invention

According to the first and second aspects, the cooling equipment delivery-side temperature target value for the finisher entry-side temperature prediction value to match the finisher entry-side temperature target value is calculated. In addition, the flow amount set-up value of the coolant water in the cooling equipment is determined based on the cooling equipment delivery-side temperature target value and the learning value. Further, the flow amount standard values of the coolant water in the cooling equipment are calculated based on the flow amount set-up value, the velocity information of the rougher mill, and the rougher delivery-side temperature measured value.

The flow amount standard values are calculated such that the cooling equipment delivery-side temperature prediction value matches the target temperature pattern of the material to be rolled over the entire length of the material to be rolled at the delivery side of the cooling equipment. Once the flow amount standard values are calculated for each point of the material to be rolled, the feedforward control is performed such that the flow amounts of the coolant water in the cooling equipment when each point of the material to be rolled reaches the position cooled by the cooling equipment respectively match these flow amount standard values. Therefore, since the target temperature pattern can be achieved, the finisher entry-side temperature measured value can be consistent with the finisher entry-side temperature target value. In addition, according to the first and second aspects, since the learning value is calculated, it is possible to increase the accuracy of the control of the finisher entry-side temperature.

DESCRIPTION OF EMBODIMENTS

Figure 1:
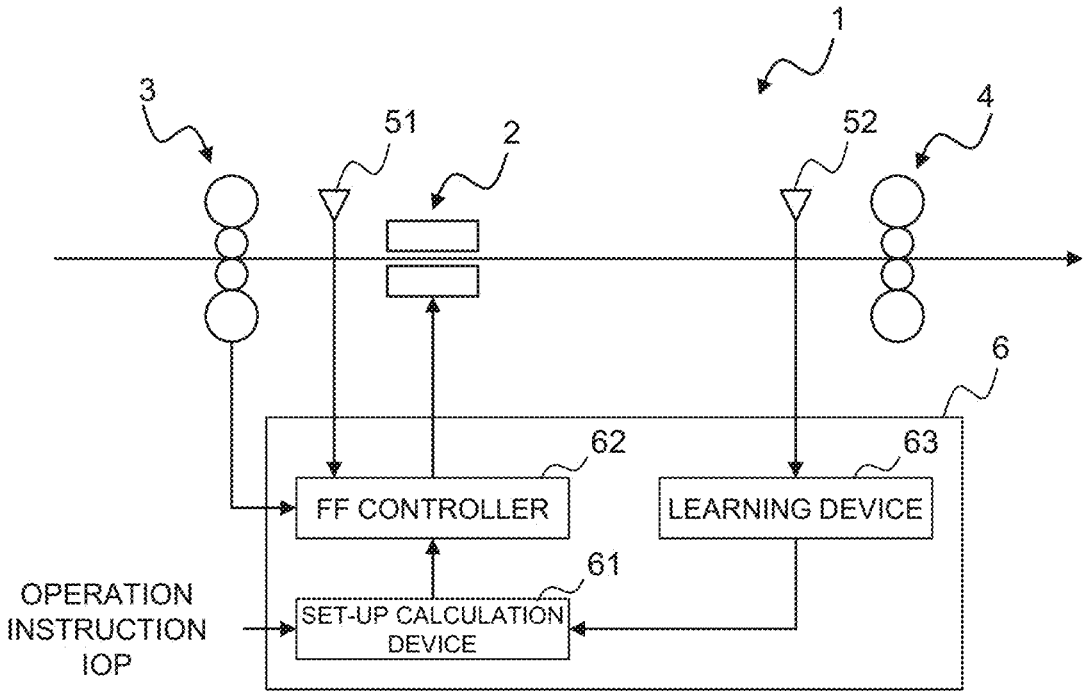
FIG. 1 is a diagram for illustrating a configuration example of a hot rolling line to which a first embodiment is applied.
Figure 2:
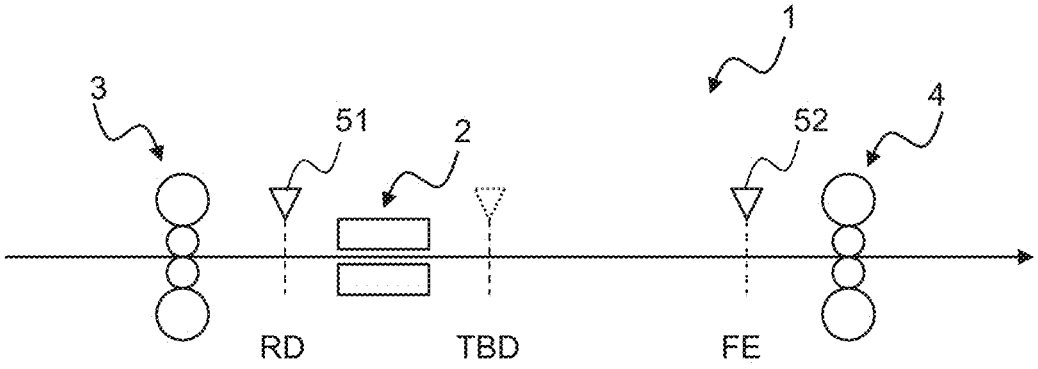
FIG. 2 is a diagram for illustrating a target position set in a delivery side of a cooling equipment.

Embodiments of the present disclosure will be described below with reference to the drawings. In the drawings, the same reference signs are given to the same elements, and the overlapping description will be omitted.

1. First Embodiment

A first embodiment will be described with reference to FIGS. 1 to 8.

1-1. Configuration Example of Hot Rolling Line

FIG. 1 is a diagram for illustrating a configuration example of a hot rolling line to which the first embodiment is applied. The hot rolling line 1 shown in FIG. 1 has a cooling equipment 2. The cooling equipment 2 is installed between a rougher mill 3 and finisher mill 4. The cooling equipment 2 is an example of an "intermediate equipment group" in the present disclosure. A table for transporting a material to be rolled (hereinafter, also referred to as a "material M") from a delivery side of the rougher mill 3 to an entry side of the finisher mill 4 is installed between the rougher mill 3 and the finisher mill 4.

The cooling equipment 2 includes, for example, water injection nozzle groups provided corresponding to a width direction and a longitudinal direction of the material M, and valves provided in common to the water injection nozzle groups. At least two of the water injection nozzle groups are provided and the valves are provided for each of these water injection nozzle groups. By controlling opening and closing of the respective valves, a flow amount of coolant water in water injection nozzles included in the water injection nozzle groups corresponding to the respective valves is adjusted. The opening and closing of the valves are controlled by a control device 6.

At least one rougher mill 3 is provided in the hot rolling line 1. The rougher mill 3 performs a rougher rolling (a reverse rolling) of the material M to reduce a thickness of the material M to an intermediate bar target value. Generally, the material M before the rougher rolling is thicker than 180 mm, and the intermediate bar target value is 30 to 65 mm. After the rougher rolling, the material M is conveyed to the finisher mill 4. The finisher mill 4 includes at least two mills installed in the hot rolling line 1. The finisher mill 4 performs a finisher rolling (a tandem rolling) of the material M to reduce the thickness of the material M to a coil thickness target value. Control of the rougher rolling by the rougher mill 3 and control of the finisher rolling by the finisher mill 4 are also performed by the control device 6.

Various kinds of measuring equipment are provided in the hot rolling line 1. The various measuring equipment include a rougher delivery-side pyrometer 51 and a finisher entry-side pyrometer 52. The rougher delivery-side pyrometer 51 is provided at a delivery side of the rougher mill 3, and measures a measured value of temperature $T_M$ of the material M passing through an installation position RD (see FIG. 2) of the rougher delivery-side pyrometer 51 (hereinafter, referred to as a "rougher delivery-side temperature measured value $T_{RD}^{mea}$" or a "measured temperature $T_{RD}^{mea}$"). The finisher entry-side pyrometer 52 is provided at an entry side of the finisher mill 4, and measures a measured value of the temperature $T_M$(hereinafter, referred to as a "finisher entry-side temperature measured value $T_F^{mea}$" or a "measured temperature $T_{FE}^{mea}$") passing through an installation position FE (see FIG. 2) of the finisher entry-side pyrometer 52. The measured temperatures $T_{RD}^{mea}$ and $T_{FE}^{mea}$ are sent to the control device 6.

The control device 6 is a computer comprising at least one processor and at least one memory. The control device 6 may be composed of at least two computers. The control device 6 performs various controls in the hot rolling line 1. The various controls include control of the cooling equipment 2 (i.e., the control of opening and closing of the valves), the control of the rougher mill 3, and the control of the finisher mill 4.

1-2. Configuration Example of Control Device

In the first embodiment, the control of the cooling equipment 2 among various controls by the control device 6 is considered. Here, there is a predetermined distance from the cooling equipment 2 to the finisher entry-side pyrometer 52. Therefore, for example, control using a temperature deviation at the target position, such as feedback control based on the measured temperature $T_{FE}^{mea}$ is not effective. Therefore, in the first embodiment, a transition of the temperature $T_M$ from the target position TBD (see FIG. 2) to the installation position FE is predicted, and the cooling equipment 2 is controlled such that the temperature $T_M$ at the installation position FE (i.e., the measured temperature $T_{FE}^{mea}$ matches a target value (hereinafter, referred to as a "finisher entry-side temperature target value $T_{FE}^{tar}$" or a "target temperature $T_{FE}^{tar}$"). In the example illustrated in FIG. 2, the target position TBD is set at the delivery side of the cooling equipment 2 and on an upstream side of the installation position FE.

In FIG. 1, as a configuration for controlling the cooling equipment 2, the control device 6 includes a set-up calculation device 61, a feed-forward (FF) control device 62, and a learning device 63. These devices are, for example, functions of the control device 6. Such functions of the control device 6 are realized by, for example, a processor included in the control device 6 executing a predetermined control program read from the memory.

The set-up calculation device 61 performs a "set-up calculation" related to the control of the cooling equipment 2. In the set-up calculation, a target value of the temperature $T_M$ at the target position TBD (hereinafter, referred to as a "cooling equipment delivery-side temperature target value $T_{TBD}^{tar}$" or a "target temperature $T_{TBD}^{tar}$") is determined based on an operation instruction IOP. The operation instruction IOP includes a use condition and a restriction of the cooling equipment 2. Depending on steel type and size of the material M, a target value of the temperature $T_M$ at the installation position FE (i.e., the finisher entry-side temperature target value $T_{FE}^{tar}$ or the target temperature $T_{FE}^{tar}$) may be included in the operation instruction IOP. In the set-up calculation, it is determined whether to perform cooling of the material M for each valve of the cooling equipment 2 based on the target temperature $T_{TBD}^{tar}$. In the set-up calculation, a flow amount set-up value Q of the coolant water in the water injection nozzles corresponding to the valve for cooling the material M is further determined. In the set-up calculation, a flow amount-temperature change influence coefficient $Inf_{cnt}$ indicating a change in the temperature $T_M$ with respect to a change in the flow amount of the coolant water is further calculated. An example of a method for determining the target temperature $T_{TBD}^{tar}$ and an example of a method for determining the flow amount set-up value Q will be described later.

The FF controller 62 executes "FF control" of the flow amount of the coolant water in the cooling equipment 2. In the FF control, a flow amount standard value of the coolant water in the cooling equipment 2 is calculated for each point of the material M such that a pattern of the target temperature $T_{TBD}^{tar}$ set over whole length of the material M (hereinafter, also referred to as a "target temperature pattern $T_{TBD}^{tar}(i)$") is fulfilled. In the FF control, further, velocity of the material M during rolling by the rougher mill 3 is grasped based on rotation speed of a roll of the rougher mill 3, a rolling reduction, and the like, and positions of respective points of the material M passing through the rougher mill 3 is grasped. After a tail end of the material M has passed through the rougher mill 3, the velocity of the material M is grasped based on velocity of a table for conveying the material M. In the FF control, furthermore, the flow amount of the coolant water is changed such that the flow amount standard values of the coolant water calculated for respective points are realized at respective timings when respective points of the material M reach a position cooled by the coolant water from the cooling equipment 2, in consideration of a response delay of the cooling equipment 2. A specific example of the FF control will be described later.

The learning device 63 performs "learning calculation" for calculating a learning value $\Delta T_{TBD}^{ofs}$ based on the measured temperature $T_{FE}^{mea}$. The learning value $\Delta T_{TBD}^{ofs}$ is used to correct the target value of the temperature of the material M (i+1) at the target position TBD in the set-up calculation for the material M (i+1) to be rolled in the hot rolling line 1 next to the material M (i) that is rolled at present. A specific example of the learning calculation will be described later.

1-3. Example of Method to Determine Target Temperature $T_{TBD}^{tar}$

Figure 3:
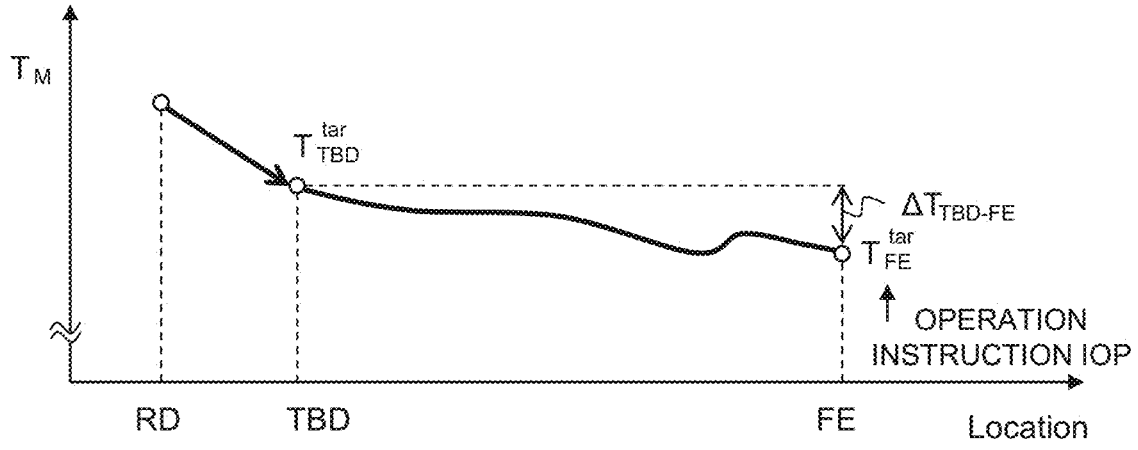
FIG. 3 is a diagram for illustrating a target value of a temperature of a material to be rolled at the target position.

FIG. 3 is a diagram for illustrating the target temperature $T_{TBD}^{tar}$. FIG. 3 shows a transition of the temperature $T_M$ at a position x of the material M with reference to the longitudinal direction when the material M is conveyed from the rougher mill 3 to the finisher mill 4. The target temperature $T_{FE}^{tar}$ is usually given as a temperature target value when a tip end section of the material M passes through the installation position FE. The target temperature $T_{FE}^{tar}$ is determined according to, for example, the operation instruction IOP. In another example, the target temperature $T_{FE}^{tar}$ is determined to maximize a production amount as much as possible. The target temperature $T_{FE}^{tar}$ determined before a final pass of the rougher rolling is performed on the material M.

Materials (ductility, hardness, and the like) of the material M correlate with a history of the temperature $T_M$. For steel types with strict requirements for the materials, the temperature of the material M needs to be controlled according to the operation instruction IOP. In this case, the temperature target value given by the operation instruction IOP is set as the target temperature $T_{FE}^{tar}$. On the other hand, for a steel grade for which the material requirements are not stringent, the target temperature $T_{FE}^{tar}$ may not be required. In addition, in the hot rolling line 1, the production amount is sometimes required, and in this case, it is desirable to perform rolling in a time as short as possible. Therefore, when the temperature target value is not given by the operation instruction IOP, a low temperature is set to the target temperature $T_{FE}^{tar}$ in order to increase the velocity of the material M being rolled by the finisher mill 4 (i.e., a finisher rolling velocity).

However, if the finisher rolling velocity is too high, an intervention operation by an operator may not be in time. Also, a load of the finisher mill may reach its upper limit. Therefore, in the first embodiment, the finisher entry-side temperature is calculated under a condition where the finisher rolling velocity is set to the highest velocity in an allowable velocity range and a target value of the finisher delivery-side temperature (hereinafter, referred to as a "finisher delivery-side temperature target value $T_{FD}^{tar}$" or a "target temperature $T_{FD}^{tar}$") can be achieved. Then, the finisher entry-side temperature is set to the target temperature $T_{FE}^{tar}$. The "finisher delivery-side temperature" is the temperature $T_M$ at the delivery side of the finisher mill 4, and the "finisher entry-side temperature" is the temperature $T_M$ at the entry side of the finisher mill 4.

The target temperature $T_{TBD}^{tar}$ is determined by, for example, the following procedure.

(a) set an initial value of the finisher entry-side temperature as an assumed value of the finisher entry-side temperature (hereinafter referred to as an "assumption temperature $T_{FE}^{asu}$");

(b) set the finisher rolling velocity to the highest velocity in the allowable velocity range;

(c) calculating a temperature drop from the installation position FE to a measurement position of the temperature $T_M$ at the delivery side of the finisher mill 4, and calculating a predicted value of the finisher delivery-side temperature;

(d) when the predicted value of the finisher delivery-side temperature and the target value substantially match, the assumption temperature $T_{FE}^{asu}$ currently is set as the target temperature $T_{FE}^{tar}$; and (e) when a difference occurs between the predicted value and the target value of the finisher delivery-side temperature, the assumption temperature $T_{FE}^{asu}$ is changed.

The procedures (a) to (c) and (e) are repeatedly performed until a result that the predicted value and the target value are substantially matched is obtained in the procedure (d). The change of the assumption temperature $T_{FE}^{asu}$ in the procedure (e) can be performed based on a magnitude relation between the predicted value and the target value. For example, if the predicted value is larger than the target value, the difference between the two values or a value obtained by multiplying the difference by a gain is subtracted from the assumption temperature $T_{FE}^{asu}$ used in the procedure (c) to obtain a new assumption temperature $T_{FE}^{asu}$. If the predicted value is smaller than the target value, the difference between the two values or a value obtained by multiplying the difference by a gain is added to the assumption temperature $T_{FE}^{asu}$ used in the procedure (c) to obtain a new assumption temperature $T_{FE}^{asu}$. The highest velocity used in the procedure (b) may be determined by an operator or may be set in advance for each steel type or size.

In FIG. 3, the target temperature $T_{TBD}^{tar}$ is depicted in addition to the target temperature $T_{FE}^{tar}$. From the target position TBD to the installation position FE, the temperature $T_M$ changes due to an air cooling, a heat insulation, and a heating. This temperature change amount $\Delta T_{TBD-FE}$ is taken into account in the determination of the target temperature $T_{TBD}^{tar}$. Also, if the learning value $\Delta T_{TBD}^{ofs}$ has been calculated, this learning value $\Delta T_{TBD}^{ofs}$ is taken into account in the determination of the target temperature $T_{TBD}^{tar}$.

Figure 4:
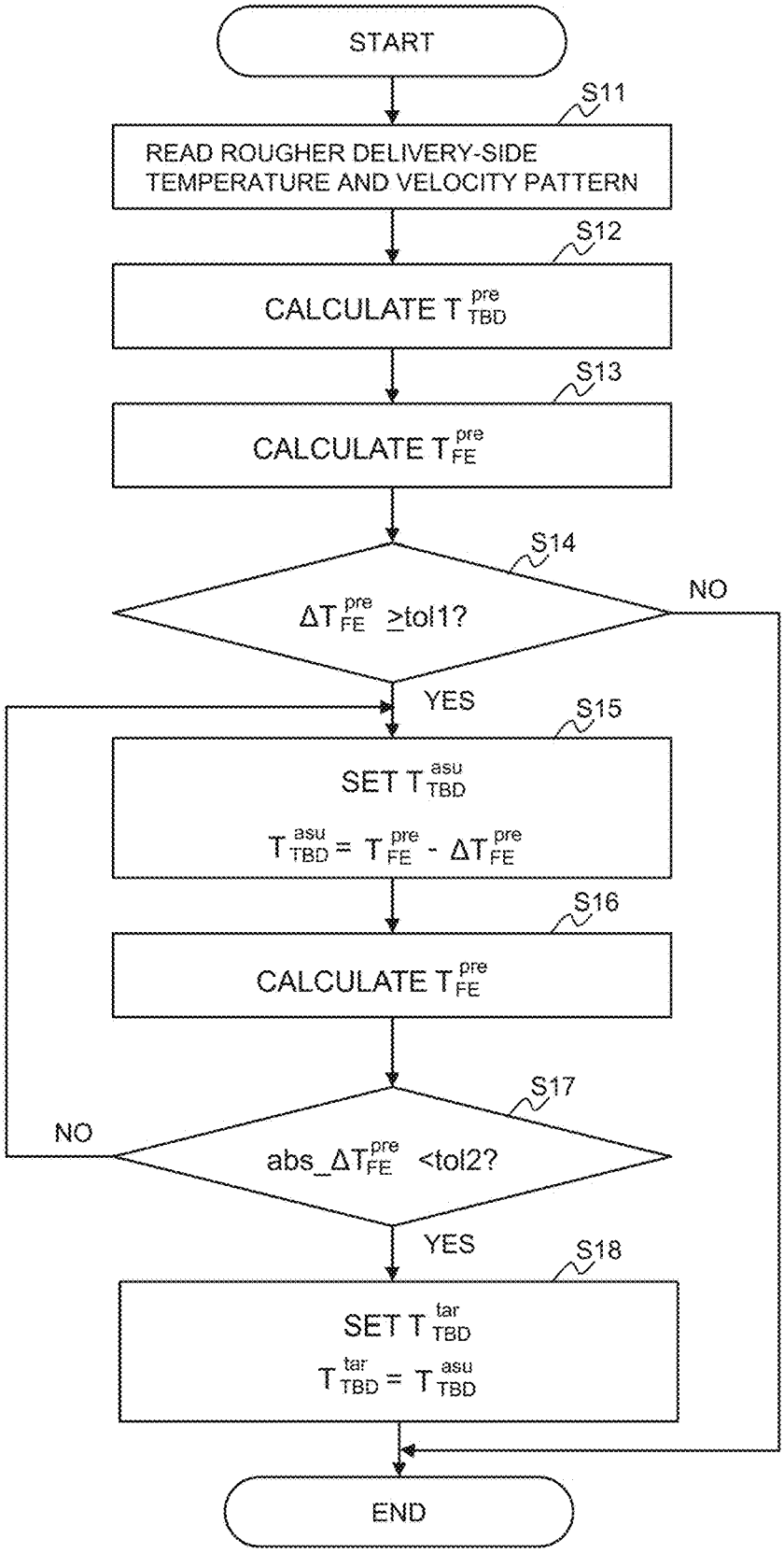
FIG. 4 is a flowchart for illustrating a flow of processing performed by a set-up calculation device to determine the target value of the temperature of the material to be rolled at the target position.

FIG. 4 is a flowchart for illustrating the flow of processing performed by the set-up calculation device 61 to determine the target temperature $T_{TBD}^{tar}$. In the processing routine shown in FIG. 4, first, the rougher delivery-side temperature and the velocity pattern are read (step S11). As the "rougher delivery-side temperature", the predicted value of the "rougher delivery-side temperature" or the target value of the "rougher delivery-side temperature" included in the operation instruction IOP is used until the "measured temperature $T_{RD}^{mea}$" is acquired. The velocity pattern to be read is a pattern predicted for the velocity of the material M passing through the cooling equipment 2, and the details thereof will be described later.

Subsequent to the processing of step S11, a predicted value of the temperature $T_M$ at the target position TBD when the material M is conveyed from the installation position RD to the target position TBD (hereinafter referred to as a "cooling equipment delivery-side temperature prediction value $T_{TBD}^{pre}$" or a "prediction temperature $T_{TBD}^{pre}$") is calculated based on Equation (1) (step S12).

[Formula 1]

$$T_{TBD}^{pre} = T_{RD}^{mea} - \int_{RD}^{TBD} f\,(T_M\,(x), \sigma, \varepsilon, \rho, \varphi\,(T_M\,(x)), ht_{air}\,(x), v\,(x))\,dx \tag{1}$$

The variables on the right side of Equation (1) are as follows.

$T_{RD}^{mea}$: Rougher delivery-side temperature measured value[degC]

$T_M$: Temperature of the material to be rolled[degC]

Σ: Stefan-Boltzmann coefficient

E: Emissivity

P: Density[kg/m3]

φ: Specific heat[kJ/(kg·degC)]

$ht_{air}$: Convective heat transfer rate with air[W/mm]

v: Velocity of the material to be rolled[m/s]

x: Position from the head end of the material to be rolled[m]

In the processing of step S12, the prediction temperature $T_{TBD}^{pre}$ under the condition where the cooling equipment 2 is not used is calculated. A temperature falling amount $\Delta T_{TBD}^{rad}$ from the installation position RD to the target position TBD in the case where the cooling equipment 2 is not used is calculated based on Equation (2).

[Formula 2]

$$\Delta T_{TBD}^{rad} = T_{RD}^{mea} - T_{TBD}^{pre} \tag{2}$$

Subsequent to the processing of step S12, a predicted value of the temperature $T_M$ at the installation position FE when the material M is conveyed from the target position TBD to the installation position FE (hereinafter referred to as a "finisher entry-side temperature prediction value $T_{FE}^{pre}$" or a "prediction temperature $T_{FE}^{pre}$") is calculated based on Equation (3) (step S13). The variable of the second term on the right side of Equation (3) is the same as that of Equation (1).

[Formula 3]

$$T_{FE}^{pre} = T_{TBD}^{pre} - \int_{TBD}^{FE} f\,(T_M(x), \sigma, \varepsilon, \rho, \varphi(T_M(x)), ht_{air}(x), v(x))\,dx \tag{3}$$

Subsequent to the processing in step S13, it is determined whether or not a difference $\Delta T_{FE}^{pre}$ ($=T_{FE}^{pre}-T_{FE}^{tar}$) between the prediction temperature $T_{FE}^{pre}$ calculated in step S13 and the target temperature $T_{FE}^{tar}$ equal to or greater than a threshold value tol1 (step S14). The threshold value tol1 is set in advance as a value at which the prediction temperature $T_{FE}^{pre}$ and the target temperature $T_{FE}^{tar}$ are considered to be almost identical (tol1≥0). If it is determined that the difference $\Delta T_{FE}^{pre}$ is smaller than the threshold value tol1, the processing routine is ended (i.e., the material M is not cooled by the cooling equipment 2). The case where the difference $\Delta T_{FE}^{pre}$ is equal to or less than the threshold value tol1 includes a case where the difference $\Delta T_{FE}^{pre}$ a negative value (i.e., a case where the prediction temperature $T_{FE}^{pre}$ is lower than the target temperature $T_{FE}^{tar}$).

When it is determined that the difference $\Delta T_{FE}^{pre}$ is equal to or larger than the threshold value tol1, the processing of step S15 is performed. In the processing of step S15, the difference $\Delta T_{FE}^{pre}$ is subtracted from the prediction temperature $T_{FE}^{pre}$. The value after the subtraction ($=T_{FE}^{pre}-\Delta T_{FE}^{pre}$) is set to an assumed value of the temperature $T_M$ at the target position TBD (hereinafter referred to as a "cooling equipment delivery side assumption temperature $T_{TBD}^{asu}$" or an "assumption temperature $T_{TBD}^{asu}$").

Subsequent to the processing of step S15, the prediction temperature $T_{FE}^{pre}$ is calculated (step S16). In the processing of step S16, the assumption temperature $T_{TBD}^{asu}$ calculated in step S15 is substituted into the first term (i.e., $T_{TBD}^{pre}$) on the right side of Equation (3), and the prediction temperature $T_{FE}^{pre}$ is calculated.

Subsequent to the processing of step S16, it is determined whether an absolute value abs_$\Delta T_{FE}^{pre}$ of the difference $\Delta T_{FE}^{pre}$ is smaller than a threshold value tol2 (step S17). In the processing of step S17, the difference $\Delta T_{FE}^{pre}$ is a difference between the prediction temperature $T_{FE}^{pre}$ calculated in step S16 and the target temperature $T_{FE}^{tar}$. The threshold value tol2 is set in advance as a value at which the prediction temperature $T_{FE}^{pre}$ and the target temperature $T_{FE}^{tar}$ are recognized to be almost identical. The threshold value tol2 may be equal to the threshold value tol1.

If it is determined that absolute value abs $\Delta T_{FE}^{pre}$ less than threshold value tol2, then the assumption temperature $T_{TBD}^{asu}$ calculated in step S15 is set to the target temperature $T_{TBD}^{tar}$ (step S18).

On the other hand, when it is determined that the absolute value abs_$\Delta T_{FE}^{pre}$ is equal to or larger than threshold value tol2, the processing of step S15 is performed again. In this case, however, the difference $\Delta T_{FE}^{pre}$ calculated in step S16 is subtracted from the prediction temperature $T_{FE}^{pre}$ calculated in step S17. The processing in step S16 and subsequent steps is performed using the value after the subtraction ($=T_{FE}^{pre}-\Delta T_{FE}^{pre}$). That is, when a negative judgement result is obtained in step S17, the processing of steps S15 to S17 is repeatedly performed.

1-4. Example of Method to Determine Flow Amount Set-Up Value Q

Figure 5:
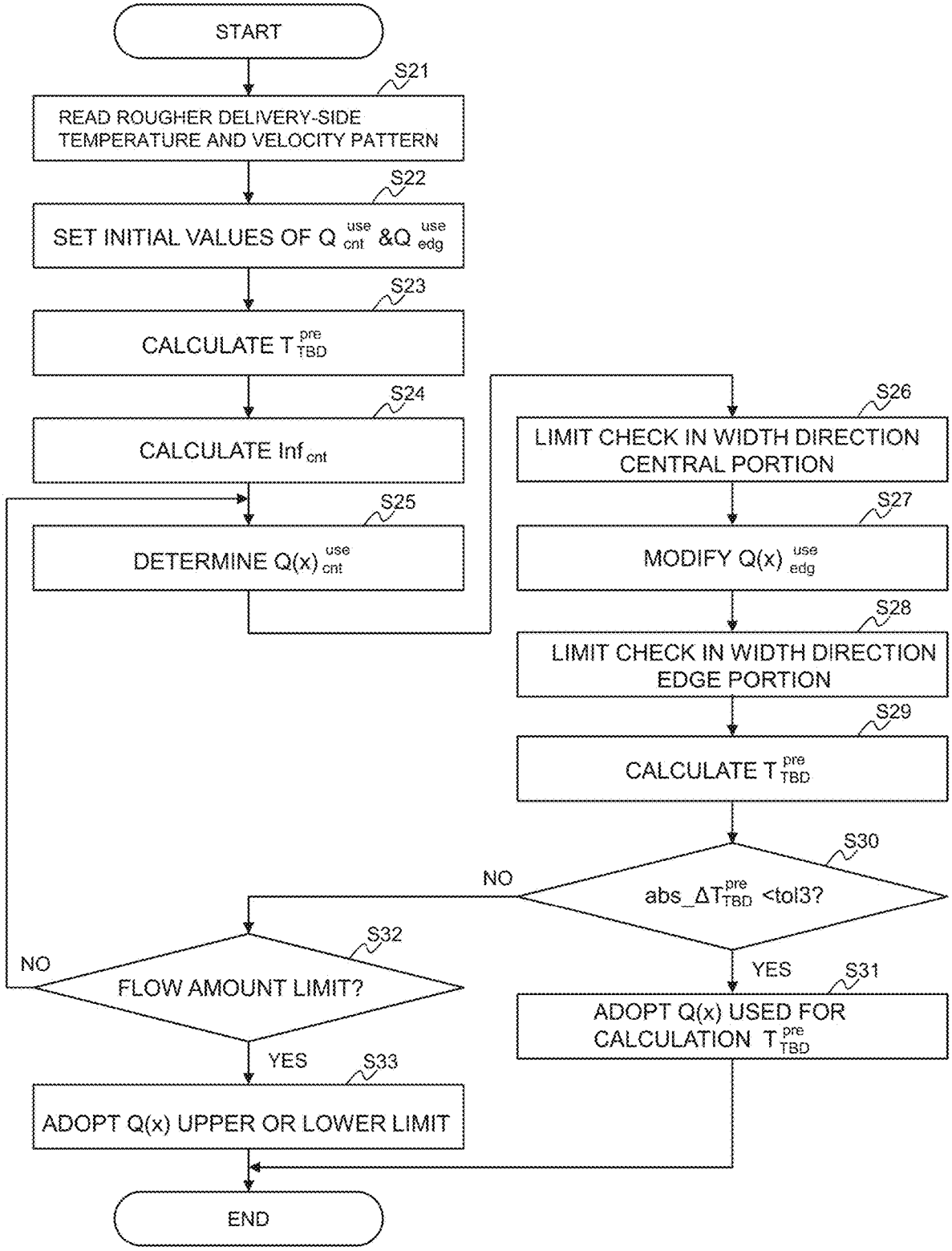
FIG. 5 is a flowchart for illustrating a flow of processing performed by the set-up calculation device to determine a flow amount set-up value.

FIG. 5 is a flowchart for illustrating a flow of processing performed by the set-up calculation device 61 to determine the flow amount set-up value Q. In the processing routine shown in FIG. 5, first, the rougher delivery-side temperature and the velocity pattern are read (step S21). The content of the processing of step S21 is the same as that of the processing of step S11 described in FIG. 4.

Subsequent to the processing of step S21, a flow amount standard value $Q_{cnt}^{std}$ of the coolant water in the width direction central portion of the cooling equipment 2 and a flow amount standard value $Q_{edg}^{std}$ of the coolant water in the width direction edge portion are set as initial values of the flow amount set-up value Q (step S22). An initial value $Q(x)_{cnt}^{use}$ of the flow amount set-up value Q(x) in a width direction central portion for the position x of the material M with reference to the longitudinal direction is expressed by Equation (4), and the flow amount set-up value $Q(x)_{edg}^{use}$ in the width direction edge portion for the same position x is expressed by Equation (5).

[Formula 4]

$$Q_{cnt}^{use}(x) = Q_{cnt}^{std} \tag{4}$$

[Formula 5]

$$Q_{edg}^{use}(x) = Q_{edg}^{std} \tag{5}$$

The flow amount standard values $Q_{cnt}^{std}$ and $Q_{edg}^{std}$ are prepared in advance as parameters for each steel type and size of the material M. Under these initial conditions, the predicted value of the temperature $T_M$ at the target position TBD when the material M is conveyed from the installation position RD to the target position TBD (i.e., the prediction temperature $T_{TBD}^{pre}$) is calculated based on Equations (6) and (7) (step S23).

[Formula 6]

$$T_{TBD}^{pre} = T_{RD}^{mea} - \int_{RD}^{TBD} f\,(T_M\,(x),\,\sigma,\,\varepsilon,\,\rho,\,\varphi\,(T_M\,(x)),\,ht_{air}\,(x),\,v\,(x),\,ht_{wtr}\,(x))\,dx \tag{6}$$

[Formula 7]

$$ht_{wtr}\,(x) = f\,(v\,(x),\,Q\,(x),\,etc) \tag{7}$$

The variables in Equations (6) and (7) are as follows.

$ht_{wtr}$: Water-cooling heat transfer rate[W/mm]

Q: Flow amount set-up value of the coolant water[m3/hr]

A change in the temperature $T_M$ in the width direction is dominantly affected by the change in the flow amount of the width direction central portion. Therefore, the flow amount set-up value $Q(x)_{cnt}^{use}$ in the width direction central portion is used as the flow amount set-up value Q(x). A change in the flow amount of the coolant water in the width direction edge portion may affect the change in the temperature $T_M$ in the width direction. In this case, the flow amount set-up value $Q(x)_{cnt}^{use}$ may be corrected using the flow amount set-up value $Q(x)_{edg}^{use}$ in the width direction edge portion. The flow amount set-up value Q(x) in the former case is expressed by Equation (8), and the flow amount set-up value Q(x) in the latter case is expressed by Equation (9).

[Formula 8]

$$Q\,(x) = Q_{cnt}^{use}\,(x) \tag{8}$$

[Formula 9]

$$Q\,(x) = Q_{cnt}^{use}\,(x) + \gamma \cdot Q_{edg}^{use}\,(x) \tag{9}$$

In Equation (9), γ is a coefficient for converting the influence of the change in the flow amount of the coolant water in the width direction edge portion on the change in the temperature $T_M$ in the width direction central portion into the flow amount of the coolant water in the width direction central portion.

Subsequent to the processing of step S23, a flow amount-temperature change influence coefficient $Inf_{cnt}$ is determined (step S24). The influence coefficient $Inf_{cnt}$ is calculated based on the temperature falling amount $\Delta T_{TBD}^{rad}$ calculated based on Equation (2), a temperature falling amount $\Delta T_{TBD}^{pre}$ calculated based on Equation (10), and the flow amount standard value $Q_{cnt}^{std}$ (Equation 11). The value calculated in step S23 is used as the prediction temperature $T_{TBD}^{pre}$ in the second term on the right side of Equation (10).

[Formula 10]

$$\Delta T_{TBD}^{pre} = T_{RD}^{mea} - T_{TBD}^{pre} \tag{10}$$

[Formula 11]

$$Inf_{cnt} = \frac{\Delta T_{TBD}^{pre} - \Delta T_{TBD}^{rad}}{Q_{cnt}^{std}} \tag{11}$$

Subsequent to the processing of step S24, the flow amount set-up value $Q(x)_{cnt}^{use}$ of the coolant water of the width direction central portion for realizing the target temperature $T_{TBD}^{tar}$ is determined based on the influence coefficient $Inf_{cnt}$ and a difference $\Delta T_{TBD}$ between the prediction temperature $T_{TBD}^{pre}$ and the target temperature $T_{TBD}^{tar}$ according to Equation (12) (step S25).

[Formula 12]

$$Q_{cnt}^{use}\,(x) = Q_{cnt}^{use}\,(x) + \left(\alpha_{mod}/(Inf_{cnt})\right) \cdot \Delta T_{TBD} \tag{12}$$

In Equation (12), α mod is an adjustment coefficient.

Subsequent to the processing of step S25, a limit check is performed using Equations (13) and (14) such that the flow amount set-up value $Q(x)_{cnt}^{use}$ determined in step S25 does not exceed an upper limit $Q(x)_{cnt}^{max}$ and does not fall below a lower limit $Q(x)_{cnt}^{min}$ (step S26).

[Formula 13]

$$Q_{cnt}^{use}\,(x) = \min\,(Q_{cnt}^{use}\,(x),\,Q_{cnt}^{max}\,(x)) \tag{13}$$

[Formula 14]

$$Q_{cnt}^{use}\,(x) = \max\left(Q_{cnt}^{use}\,(x),\,Q_{cnt}^{min}\,(x)\right) \tag{14}$$

Subsequent to the processing of step S26, the flow amount set-up value $Q(x)_{edg}^{use}$ in the width direction edge portion is modified to match the change in the flow amount set-up value $Q(x)_{cnt}^{use}$ (step S27). The correction of the flow amount set-up value $Q(x)_{edg}^{use}$ is performed using Equation (15).

[Formula 15]

$$Q_{edg}^{use}\,(x) = f\,(Q_{cnt}^{use}\,(x)) + Q_{edg}^{std}\,(x) \tag{15}$$

Subsequent to the processing of step S27, a limit check is performed using Equations (16) and (17) such that the flow amount set-up value $Q(x)_{edg}^{use}$ determined in step S25 does not exceed an upper limit $Q(x)_{edg}^{max}$ and does not fall below a lower limit $Q(x)_{edg}^{min}$ (step S28).

[Formula 16]

$$Q_{edg}^{use}\,(x) = \min\left(Q_{edg}^{use}\,(x),\,Q_{edg}^{max}\,(x)\right) \tag{16}$$

[Formula 17]

$$Q_{edg}^{use}\,(x) = \max\left(Q_{edg}^{use}\,(x),\,Q_{edg}^{min}\,(x)\right) \tag{17}$$

Subsequent to the processing of step S28, the prediction temperature $T_{TBD}^{pre}$ is calculated (step S29). In the processing of step S29, the flow amount set-up values $Q(x)_{cnt}^{use}$ and $Q(x)_{edg}^{use}$ calculated in steps S24 and S28 are substituted into the flow amount set-up value Q(x) on the right side of Equation (7), and the prediction temperature $T_{TBD}^{pre}$ is calculated.

Subsequent to the processing of step S29, it is determined whether an absolute value $abs_\Delta T_{TBD}^{pre}$ of the difference $\Delta T_{TBD}^{pre}$ is smaller than a threshold value tol3 (step S30). In the processing of step S30, the difference $\Delta T_{TBD}^{pre}$ is a difference between the prediction temperature $T_{TBD}^{pre}$ calculated in step S29 and the target temperature $T_{TBD}^{tar}$. The threshold value tol3 is set in advance as a value at which the prediction temperature $T_{TBD}^{pre}$ and the target temperature $T_{TBD}^{tar}$ are recognized to be almost identical. The threshold value tol3 may be equal to the threshold value tol1 or tol2.

If it is determined that the absolute value abs_$\Delta T_{TBD}^{pre}$ is smaller than the threshold value tol3, the flow amount set-up value Q(x) used for the calculation of the prediction temperature $T_{TBD}^{pre}$ is adopted (step S31).

On the other hand, if it is determined that absolute value abs_$\Delta T_{TBD}^{pre}$ is equal to or larger than threshold value tol3, a limit check of flow amount set-up value Q(x) is performed (step S32). In the limit check of step S32, two kinds of determinations are performed based on a magnitude relation between the prediction temperature $T_{TBD}^{pre}$ and the target temperature $T_{TBD}^{tar}$. That is, when the prediction temperature $T_{TBD}^{pre}$ is larger than the target temperature $T_{TBD}^{tar}$, it is determined whether the flow amount set-up value Q(x) used for the calculation of the prediction temperature $T_{TBD}^{pre}$ is an upper limit. If the prediction temperature $T_{TBD}^{pre}$ is smaller than the target temperature $T_{TBD}^{tar}$, it is determined whether the flow amount set-up value Q(x) used for calculating the prediction temperature $T_{TBD}^{pre}$ is a lower limit.

In the first or second case where a positive judgement result is obtained in the processing of step S32, the processing of step S33 is performed. In the first case, that is, when the prediction temperature $T_{TBD}^{pre}$ is larger than the target temperature $T_{TBD}^{tar}$ and the flow amount set-up value Q(x) used for calculating the prediction temperature $T_{TBD}^{pre}$ is the upper limit, the upper limit is adopted as the flow amount set-up value Q(x). In the second case, that is, when the prediction temperature $T_{TBD}^{pre}$ is smaller than the target temperature $T_{TBD}^{tar}$ and the flow amount set-up value Q(x) used for calculating the prediction temperature $T_{TBD}^{pre}$ is the lower limit, the lower limit is adopted as the flow amount set-up value Q(x).

When the positive judgement result is not obtained in the processing of step S32, the processing of step S25 is performed again. That is, when a negative judgement result is obtained in step S32, the processing of steps S25 to S32 is repeatedly performed.

In the processing routine of FIG. 5, the example in which the flow amount standard value is set in the middle portion and the edge portion of the width direction has been described. However, the cooling equipment 2 may be further divided in the width direction to set the flow amount standard value. Even in this case, the flow amount set-up value Q(x) in all the portions in the width direction can be determined by setting the initial value $Q(x)_{cnt}^{use}$ of the flow amount set-up value Q(x) and correcting the flow amount of each portion in accordance with the change of the flow amount of the width direction central portion.

1-5. Velocity Pattern

Figure 6:
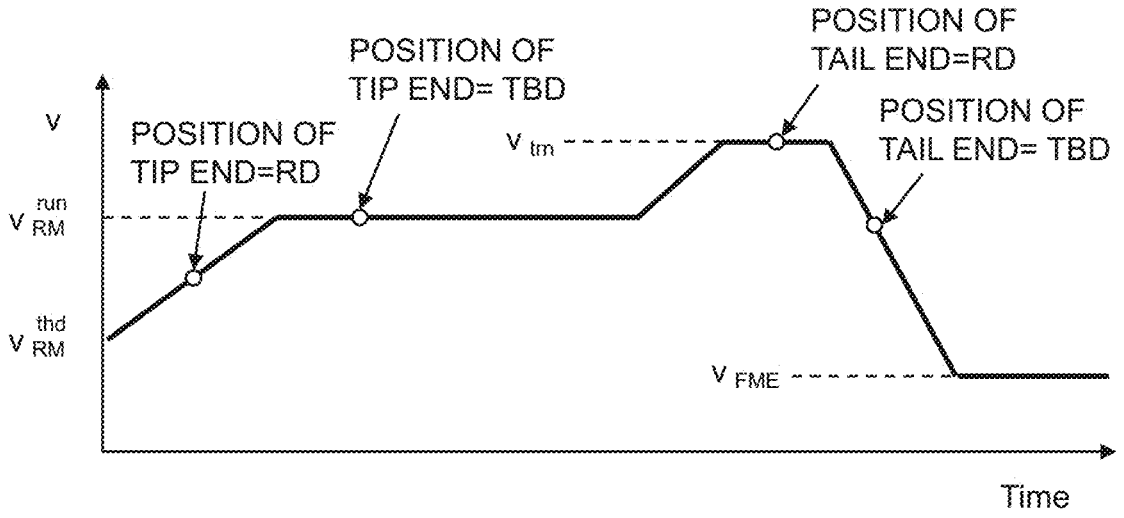
FIG. 6 is a diagram for illustrating a velocity pattern.

The velocity pattern will be described with reference to FIG. 6. The velocity pattern of the material M varies depending on a manipulation of the rougher rolling and the finisher rolling. In the example shown in FIG. 6, the velocity of the material M when entering the rougher mill 3 (a rougher approaching velocity) is a velocity $v_{RM}^{thd}$. In order to roll the material M as fast as possible, the velocity of the material M during the rougher rolling (a rougher rolling velocity) is increased to a velocity $v_{RM}^{run}$. In order to convey the material M as fast as possible after the rougher rolling, the conveying velocity of the material M is increased to a velocity $v_{trn}$. On the other hand, in the finisher rolling, since a velocity constraint at the entry side of finisher mill 4 is taken into consideration, the velocity of the material M at the entry side of finisher mill 4 (a finisher entry-side velocity) decreases to a velocity $v_{FME}$. Therefore, the range of the velocity change of the tip end section of the material M is different from that of the tail end section of the material M. The velocities $v_{RM}^{thd}$, $v_{RM}^{run}$, and $v_{trn}$ are set in advance and included in the operation instruction IOP, for example.

1-6. Specific Example of FF Control

In the FF control, the flow amount standard value of the coolant water in the cooling equipment 2 is calculated for each point of the material M such that the target temperature pattern $T_{TBD}^{tar}(i)$ set over the whole length of the material M is achieved by using the flow amount set-up value Q, the influence coefficient $Inf_{cnt}$, and the velocity pattern of the material M. When a common target temperature $T_{TBD}^{tar}$ is set over the whole length of the material M, the target temperature $T_{TBD}^{tar}$ (x) at the position x of the material M is expressed by Expression (18). When the target temperature $T_{TBD}^{tar}$ is increased from the tip end section to the tail end section of the material M in order to compensate the temperature drop due to a thermal rundown, or when the target temperature $T_{TBD}^{tar}$ is decreased from the tip end section to the tail end section in order to increase the velocity of the material M, the target temperature $T_{TBD}^{tar}$ (x) is expressed by Equation (19).

[Formula 18]

$$T_{TBD}^{tar}(x) = T_{TBD}^{tar} \tag{18}$$

[Formula 19]

$$T_{TBD}^{tar}(x) = T_{TBD}^{tar} + \Delta T_{CH} \cdot \frac{x}{L_{bar}} \tag{19}$$

The variables on the right side of Equation (19) are as follows.

$\Delta T_{CH}$: Temperature drop compensation amount[degC]

$L_{bar}$: Length of the material to be rolled[m]

x: Position from the head end of the material to be rolled[m]

The FF control is started from the timing at which the material M reaches the installation position RD after the rougher rolling and the measured temperature $T_{RD}^{mea}$ is acquired. The measured temperature $T_{RD}^{mea}$ varies in the longitudinal direction of the material M. Therefore, by appropriately changing the flow amount of the coolant water according to the position x of the material M, it is possible to suppress an occurrence of the fluctuation in the temperature $T_M$ at the target position TBD.

In order to appropriately change the flow amount of the coolant water according to the position x, a plurality of segments obtained by virtually dividing the material M in the longitudinal direction are considered. Each segment is an example of "each point in the longitudinal direction of the material to be rolled" in the present disclosure. The flow amount standard value is determined for each segment. For example, the segment is assumed to be 1m long. In this case, the flow amount standard value is determined by using the measured temperature $T_{RD}^{mea}$ for each 1m. Examples of a method to determine the flow amount standard value in this case include the convergence calculation described in the method to determine the flow amount set-up value Q.

In the FF control, the position x of the material M and the velocity of the position x are grasped based on information such as rotation speed of the roll of the rougher mill 3, an amount of rolling reduction, and velocity of the conveying table. When a certain segment passes through the installation position RD, the flow amount standard value is calculated, and the opening and closing of the respective valves is controlled such that the flow amount standard value is realized at the timing when the segment reaches the position where the segment is cooled by the coolant water from the cooling equipment 2. According to such the control, it is possible to achieve the target temperature pattern $T_{TBD}^{tar}$ (i) set over the whole length of the material M.

1-7. Specific Example of Learning Calculation

In the learning calculation, the learning value $\Delta T_{TBD}^{ofs}$ is calculated and updated. The learning calculation is performed at the timing when the material M cooled by the coolant water reaches the installation position FE and the measured temperature $T_{FE}^{mea}$ is acquired. In the learning calculation, in addition to the measured temperatures $T_{TBD}^{mea}$ and $T_{FE}^{mea}$, a re-prediction value of the temperature $T_M$ at the installation position FE (hereinafter, referred to as a "finisher entry-side temperature re-prediction value $T_{FE}^{repre}$" or a "re-prediction temperature $T_{FE}^{repre}$") are used. The calculation of the re-prediction temperature $T_{FE}^{repre}$ is performed based on, for example, a measured temperature $T_{TBD}^{mea}$ (h) and a $T_{FE}^{mea}$ (h) of a h-th segment from the head end and an actual velocity of the segment (h).

In the calculation of the re-prediction temperature $T_{FE}^{repre}$, a temperature falling amount $\Delta T_{TBD}^{rad}$ (h) when the segment (h) is conveyed from the installation position RD to the target position TBD is predicted using the actual velocity of the segment (h). In the calculation of the re-prediction temperature $T_{FE}^{repre}$, the temperature drop calculation of the segment (h) during the conveyance of the material M from the target position TBD to the installation position FE is performed by using the flow amount measured value of the coolant water in the cooling equipment 2.

In the learning calculation, a temperature prediction error $\Delta T_{FE}^{mea}$ is calculated by using the re-prediction temperature $T_{FE}^{repre}$ and the measured temperature $T_{FE}^{mea}$ (see Equation 20). Then, an error $\Delta T_{FE}^{mea}$ and a learning value $\Delta T_{TBD}^{ofs}$ (old) applied to the material M (i−1) rolled in the hot rolling line 1 before the material M (i) that is currently rolled are smoothed. Thus, a new learning value $\Delta T_{TBD}^{ofs}$ (new) is calculated (Equation 21). The learning value $\Delta T_{TBD}^{ofs}$ (new) is used to correct the target value of the temperature of the material M (i+1) at the target position TBD in the set-up calculation for the material M (i+1).

[Formula 20]

$$\Delta T_{FE}^{mea} = T_{FE}^{mea} - T_{FE}^{repre} \tag{20}$$

[Formula 21]

$$\Delta T_{TBD}^{ofs}\,(\text{new}) = (1-\beta)\cdot\Delta T_{TBD}^{ofs}\,(\text{old}) + \beta\cdot\Delta T_{FE}^{mea} \tag{21}$$

In Equation (21), β represents a learning gain.

1-8. Effect

According to the first embodiment described above, the set-up calculation related to the control of the cooling equipment 2 is performed such that the measured temperature $T_{FE}^{mea}$ matches the target temperature $T_{FE}^{tar}$. In this set-up calculation, the target temperature $T_{TBD}^{tar}$ and the flow amount set-up value Q are determined. After the set-up calculation, the FF control is performed. In the FF control, the target temperature pattern $T_{TBD}^{tar}$ (i) over the whole length of the material M is set based on the target temperature $T_{TBD}^{tar}$ and the flow amount standard value is determined based on the flow amount set-up value Q and the like such that the target temperature pattern $T_{TBD}^{tar}$ (i) is achieved. In the FF control, further, the opening and closing of the respective valves is controlled such that the flow amount standard value is realized. Therefore, since the target temperature pattern $T_{TBD}^{tar}$ (i) can be achieved, the measured temperature $T_{FE}^{mea}$ which is the finisher entry-side temperature can be matched with the target temperature $T_{FE}^{tar}$. In addition, according to the first embodiment, since the learning value $\Delta T_{TBD}^{ofs}$ is calculated and updated, it is possible to increase the accuracy of the control of the finisher entry-side temperature.

Figure 7:
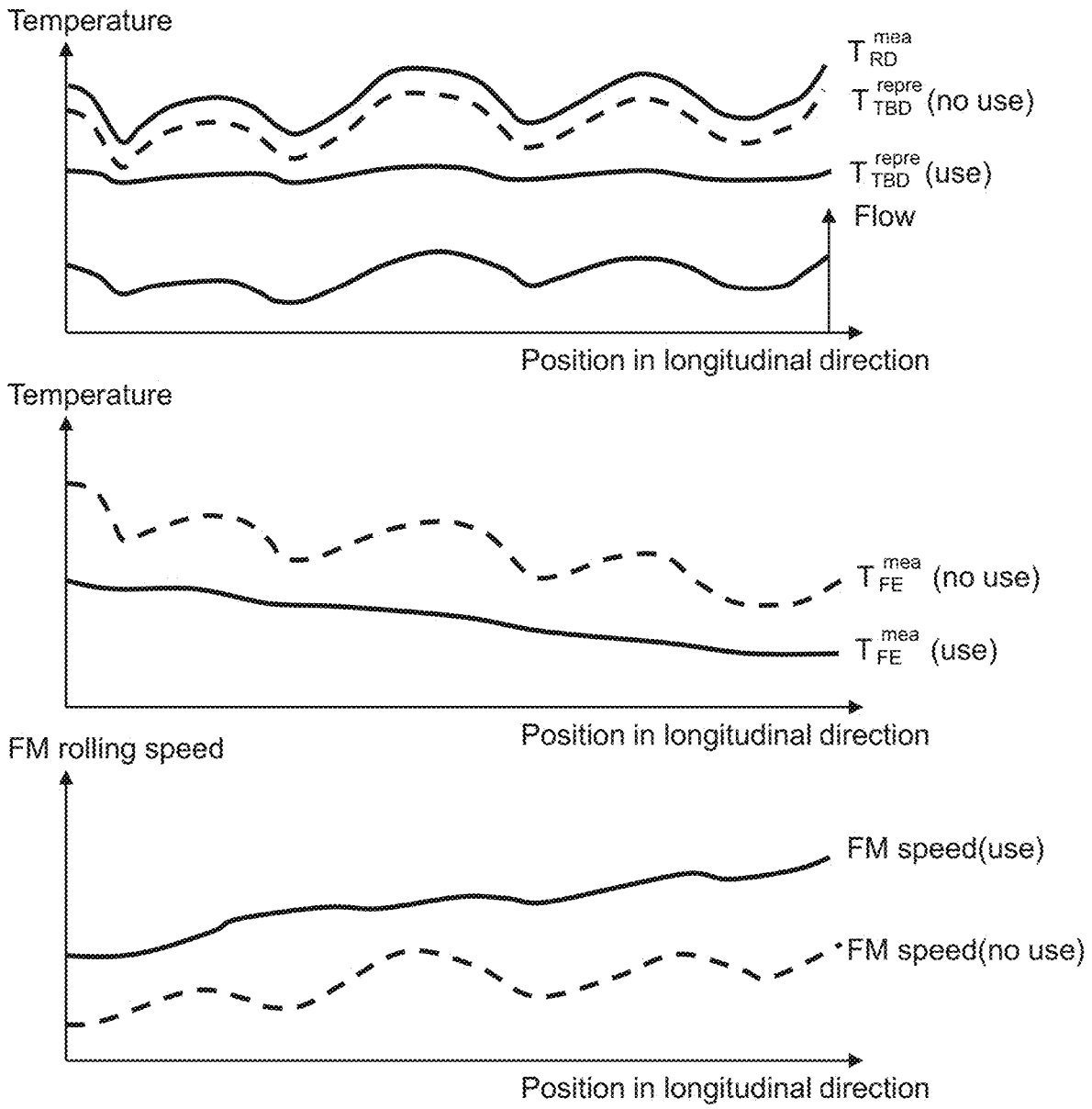
FIG. 7 is a diagram showing an example of a result of control according to the first embodiment.

FIG. 7 is a diagram for illustrating an example of a result of the control according to the first embodiment. In the upper part of FIG. 7, a transition of the measured temperature $T_{RD}^{mea}$ and transitions of two kinds of re-prediction temperature $T_{TBD}^{repre}$ are depicted. Here, the re-prediction temperature $T_{TBD}^{repre}$ is a re-prediction value of the temperature $T_M$ at the target position TBD (i.e., the cooling equipment delivery side re-prediction value). The calculation of the re-prediction temperature $T_{TBD}^{repre}$ (use) shown in FIG. 7 was performed based on the measured temperature $T_{TBD}^{mea}$, the actual velocity of the material M, and the flow amount measured value ("Flow" shown in FIG. 7) of the coolant water in the cooling equipment 2. On the other hand, the calculation of the re-prediction temperature $T_{TBD}^{repre}$ (no use) was performed based on the measured temperature $T_{TBD}^{mea}$ and the actual velocity of the material M.

As can be seen from the upper part of FIG. 7, when the measured temperature $T_{RD}^{mea}$ is uneven, the re-prediction temperature $T_{TBD}^{repre}$ (no use) when only air cooling is performed is also uneven. On the other hand, when the control according to the first embodiment is performed, the re-prediction temperature $T_{TBD}^{repre}$ (use) is maintained at a substantially constant temperature. Then, as can be seen from the middle part of FIG. 7, the measured temperature $T_{FE}^{mea}$ (use) is not uneven, and only a slow temperature drop due to the thermal rundown occurs. Therefore, the finisher rolling can be stabilized as compared with the case where the cooling equipment 2 is not used (i.e., the case of air cooling).

When the control according to the first embodiment is performed, the measured temperature $T_{FE}^{mea}$ (use) becomes a low temperature over the whole length of the material M in the longitudinal direction. Therefore, as shown in the lower part of FIG. 7, it is possible to increase the finisher rolling velocity FM.

In general, in the finisher rolling, the finisher rolling velocity FM is changed to secure a target temperature $T_{FD}^{tar}$. However, when the cooling equipment 2 is not used, the measured temperature $T_{FE}^{mea}$ (no use) is high over the whole length of the material M, and the temperature variation is also large. Therefore, in this case, it is necessary to lower the finisher rolling velocity FM, and it is also necessary to frequently change the finisher rolling velocity FM for compensate of the temperature fluctuation. In this regard, according to the control of the first embodiment, the measured temperature $T_{FE}^{mea}$ (use) is low over the whole length of the material M, and the temperature variation is also small. Therefore, since the frequency of changing the finisher rolling velocity FM can be reduced while increasing the finisher rolling velocity FM, the finisher rolling can be performed more stably.

Figure 8:
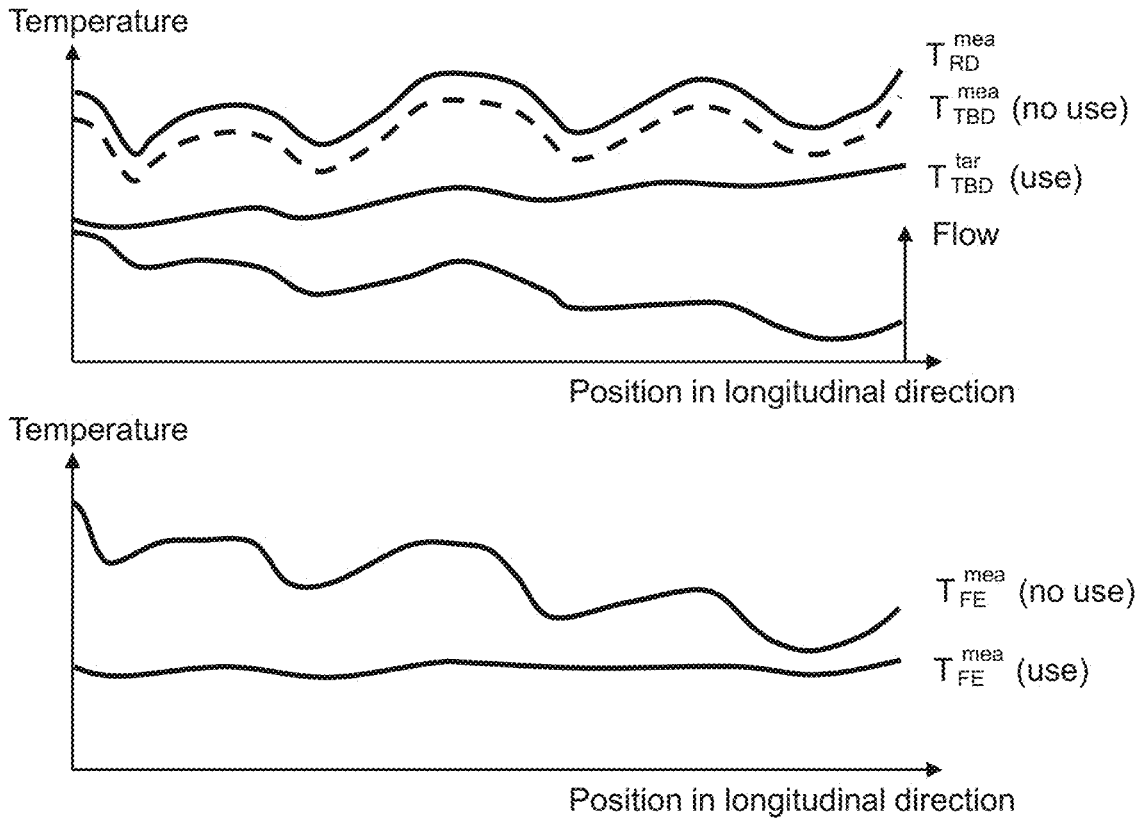
FIG. 8 is a diagram showing an example of a result when the cooling equipment is controlled by changing the target value of the temperature of the material to be rolled at the target position in a longitudinal direction of the material to be rolled.

FIG. 8 is a diagram showing an example of a result when the cooling equipment 2 is controlled by changing the target temperature $T_{TBD}^{tar}$ in the longitudinal direction of the material M. In the example shown in FIG. 8, as shown in the upper part of FIG. 8, a target temperature pattern $T_{TBD}^{tar}$ (i) in which the target temperature $T_{TBD}^{tar}$ changes in a slope shape is used. According to the control by using the target temperature pattern $T_{TBD}^{tar}$ (i), the target temperature $T_{TBD}^{tar}$ can be increased from the tip end section to the tail end section. As a result, as shown in the lower part of FIG. 8, the measured temperature $T_{FE}^{mea}$ can be kept constant, and thus, the finisher rolling can be performed at a substantially constant finisher rolling velocity.

2. Second Embodiment

The second embodiment will be described with reference to FIG. 9. Note that the description of the configuration and function common to the embodiment mentioned above will be omitted as appropriate.

2-1. Configuration Example of Hot Rolling Line

Figure 9:
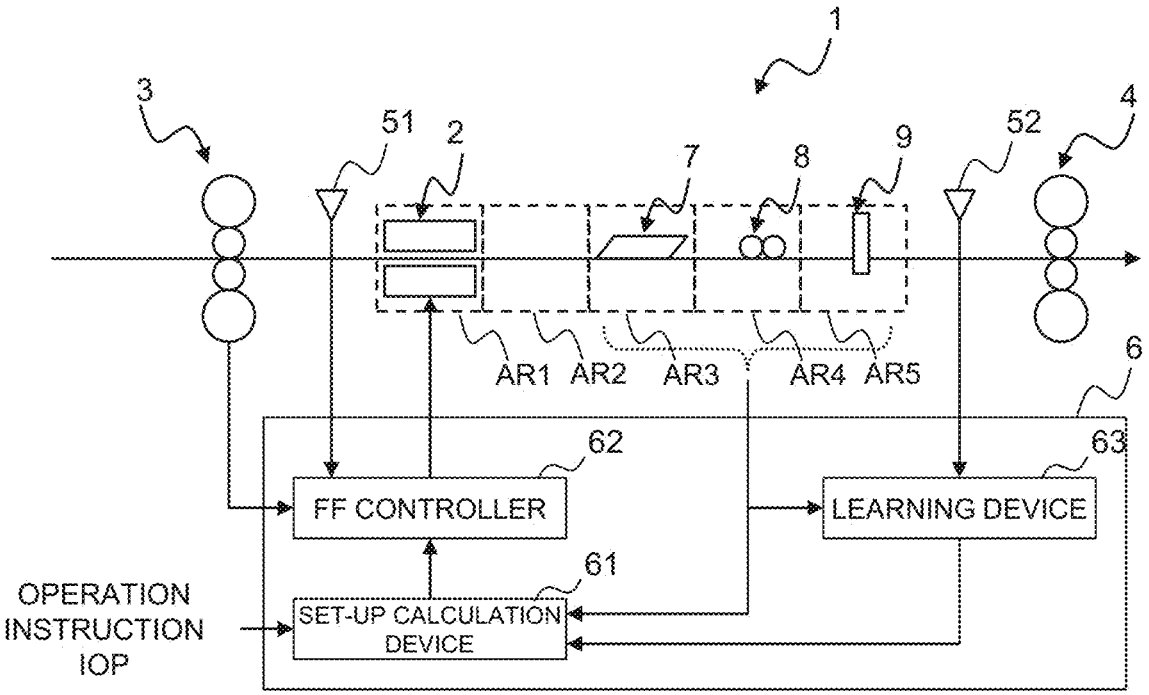
FIG. 9 is a diagram for illustrating a configuration example of a hot rolling line to which a second embodiment is applied.

FIG. 9 is a diagram for illustrating a configuration example of a hot rolling line to which the second embodiment is applied. In the example shown in FIG. 9, a table for conveying the material M is provided between the rougher mill 3 and the finisher mill 4. The above description is the same as that of the first embodiment. In the second embodiment, a heat-retention device such as a heat insulating cover 7 and a coil box 8 and a heating device such as an induction heating device 9 are installed on the conveying table and on a downstream side of the cooling equipment 2. The heat-retention device and the heating device are also examples of the "intermediate equipment group" of the present disclosure. For convenience of description, the heat-retention device and the heating device are also collectively referred to as "additional devices" below.

The heat insulating cover 7 has a mechanism for opening and closing a plurality of panels. While the panels are closed, the heat insulating cover 7 stores heat of the material M lost by radiation inside the mechanism, thereby keeping the material M warm. The coil box 8 temporarily winds the material M into a coil shape, and thus reduces contact area with outside air to keep the material M warm. The material M wound in the coil shape is rewound into a plate shape before the finisher rolling. The heat insulating cover 7 and the coil box 8 can prevent the temperature of the material M from being lowered, and can make the measured temperature $T_{FE}^{mea}$ uniform over the whole length of the material M. The induction heating device 9 increases the temperature $T_M$ by induction heating.

Use and non-use or the additional devices is selected according to the manipulation condition. For example, when the whole length of the material M is long, the coil box 8 is used to avoid the rougher mill 3 and the finisher mill 4 from being in tandem via the material M. The coil box 8 is used even when the material M is thin. The reason for this is to prevent a temperature decrease of the material M due to the thermal rundown and to reduce an amount of a temperature change $\Delta T_{TBD\text{-}FE}$ that decreases from the tip end section to the tail end section. However, since an outermost circumference section and an innermost circumference section of the coiled material M are in contact with air, the temperatures of the outermost circumference section and the innermost circumference section are lower than the temperature of a central section other than these portions. Therefore, when the coil box 8 is used together with the cooling equipment 2, it is desired to weaken the cooling of the outermost circumference section and the innermost circumference section as compared with the cooling of the central section.

2-2. Configuration Example of Control Device

In the second embodiment, the cooling equipment 2 is controlled as in the first embodiment. Therefore, the configuration of the control device 6 in the second embodiment is basically the same as that in the first embodiment. However, in the second embodiment, the set-up calculation and the learning calculation are performed in consideration of the additional devices.

2-3. Example of Set-Up Calculation

When an additional device is installed on the hot rolling line 1, the velocity pattern of the material M varies depending on the manipulation of the additional device in addition to the manipulation of the rougher rolling and the finisher rolling. The velocity (velocity $v_{FME}$) of the material M at the entry side of the finisher mill 4 needs to be set in consideration of the velocity restriction due to the manipulation of the additional devices.

In the second embodiment, the operation instruction IOP includes the manipulation setting of the additional devices. In the set-up calculation of the second embodiment, the target temperature $T_{TBD}^{tar}$ (i.e., the target value of the temperature $T_M$ at the target position TBD shown in FIG. 2) is determined based on the manipulation setting. The method to determine the target temperature $T_{TBD}^{tar}$ is basically the same as that described in FIG. 4. However, in the second embodiment, in the processing of step S13 of FIG. 4, the temperature drop calculation is performed in consideration of the manipulation setting of the additional devices.

Consider a case where the heat insulating cover 7, the coil box 8, and the induction heating device 9 shown in FIG. 9 are additional devices. In this case, for each additional device, the temperature $T_M$ at the delivery side of the additional device is calculated in consideration of the manipulation setting of the additional device. This calculation is performed by dividing the conveyance table into a plurality of areas AR1 to AR5. The area AR1 corresponds to the cooling equipment 2, the area AR3 corresponds to the heat insulating cover 7, the area AR4 corresponds to the coil box 8, and the area AR5 corresponds to the induction heating device 9. No specific device exists in the area AR2.

The position of the delivery side of the area AR1 (i.e., the target position TBD) corresponds to the position of the entry side of the area AR2, the position of the delivery side of the area AR2 corresponds to the position HCE of the entry side of the area AR3, and the position HCD of the delivery side of the area AR3 corresponds to the position of the entry side of the area AR4. The position CBD of the delivery side of the area AR4 corresponds to the position of the entry side of the area AR5, and the position of the delivery side of the area AR5 coincides with the installation position FE (see FIG. 2). The calculation of the predicted value of the temperature $T_M$ at the delivery side of the additional devices is performed based on Equations (22) to (25).

[Formula 22]

$$T_{HCE}^{pre} = T_{TBD}^{pre} - \int_{TBD}^{HCE} f(T_M(x), \sigma, \varepsilon, \rho, \varphi(T_M(x)), ht_{air}(x, t_{eh}), v(x))dx \tag{22}$$

[Formula 23]

$$T_{HCD}^{pre} = T_{HCE}^{pre} - \int_{HCE}^{HCD} f\left(T_M(x), \sigma, \varepsilon, \rho, \varphi(T_M(x)), ht_{air}^{hc}(x, t_{eh}), v(x)\right)dx \tag{23}$$

[Formula 24]

$$T_{CBD}^{pre} = T_{HCD}^{pre} - \int_{HCD}^{CBD} f\left(T_M(x), \sigma, \varepsilon, \rho, \varphi(T_M(x)), ht_{air}^{cb}(x, t_{eh}), v(x)\right)dx \tag{24}$$

-continued

[Formula 25]

$$T_{FE}^{pre} = T_{CBD}^{pre} - \int_{CBD}^{FE} f\left(T_M(x), \sigma, \varepsilon, \rho, \varphi(T_M(x)), ht_{air}^{eh}(x, t_{eh}), v(x), dt_{eh}(x)\right)dx \quad (25)$$

The variables in Equations (22) to (25) are as follows (except for the variables already described).

$T_{HCE}^{pre}$: Predicted value of the temperature $T_M$ in position HCE [degC]

$T_{HCD}^{pre}$: Predicted value of the temperature $T_M$ in position HCD [degC]

$T_{CBD}^{pre}$: Predicted value of the temperature $T_M$ in position CBD [degC]

$ht_{air}^{hc}$: Air-cooling heat transfer coefficient at area AR3 [W/mm]

$ht_{air}^{cb}$: Air-cooling heat transfer coefficient at area AR4 [W/mm]

$ht_{air}^{eh}$: Air-cooling heat transfer coefficient at area AR5 [W/mm]

$t_{hc}$: Manipulation setting of heat insulating cover 7 [-]

$t_{cb}$: Manipulation setting of coil box 8 [-]

$t_{eh}$: Manipulation setting of the induction heating device 9 [-]

$dt_{eh}$: Temperature increase amount by the induction heating device 9 [degC]

The processing other than the temperature drop calculation is the same as the processing in the first embodiment.

2-4. Example of Learning Calculation

In the learning calculation in the second embodiment, the calculation of the re-prediction temperature $T_{FE}^{repre}$ is performed based on the measured temperatures $T_{TBD}^{mea}$ (h) and $T_{FE}^{mea}$ (h) of the segment (h), the actual velocity of the segment (h), and the operation results of the additional devices. That is, the operation results of the additional devices are added to the parameter of the calculation of the re-prediction temperature $T_{FE}^{repre}$.

2-5. Effect

According to the second embodiment described above, in a case where the cooling equipment 2 and the additional device are installed in the hot rolling line 1, it is possible to obtain the same effect as the effect according to the first embodiment.

3. Third Embodiment

A third embodiment will be described with reference to FIGS. 10 and 11. Note that the description of the configuration and function common to the embodiment mentioned above will be omitted as appropriate.

3-1. Configuration Example of Hot Rolling Line

Figure 10:
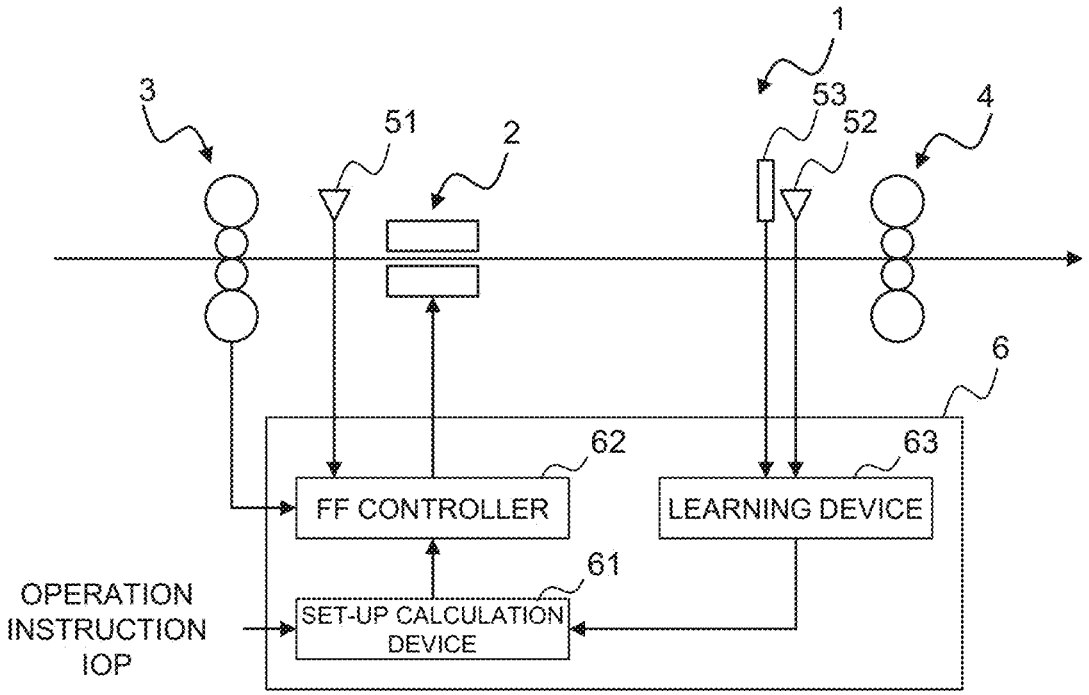
FIG. 10 is a diagram for illustrating a configuration example of a hot rolling line to which a third embodiment is applied.

FIG. 10 is a diagram for illustrating a configuration example of a hot rolling line to which the third embodiment is applied. In the example shown in FIG. 10, a scan pyrometer 53 is provided in the vicinity of the finisher entry-side pyrometer 52. The scan pyrometer 53 is included in various measuring equipment provided in the hot rolling line 1. The scan pyrometer 53 measures, for example, a temperature distribution in the width direction of the material M passing through the installation position FE (see FIG. 2) or the vicinity thereof. The scan pyrometer 53 is an example of the "finisher entry-side temperature distribution meter" in the present disclosure.

The temperature distribution in the width direction includes a measured value of the temperature $T_M$ in the central section (hereinafter referred to as a "width direction central section temperature measured value $T_{cnt_FE}^{mea}$" or a "central section measured temperature $T_{cnt_FE}^{mea}$") and a measured value of the temperature $T_M$ in the edge section (hereinafter referred to as a "width direction edge section temperature measured value $T_{edg_FE}^{mea}$" or an "edge section measured temperature $T_{edg_FE}^{mea}$"). The central section measured temperature $T_{cnt_FE}^{mea}$ and the edge section measured temperature $T_{edg_FE}^{mea}$ are transmitted to the control device 6.

3-2. Feature of Third Embodiment

Figure 11:
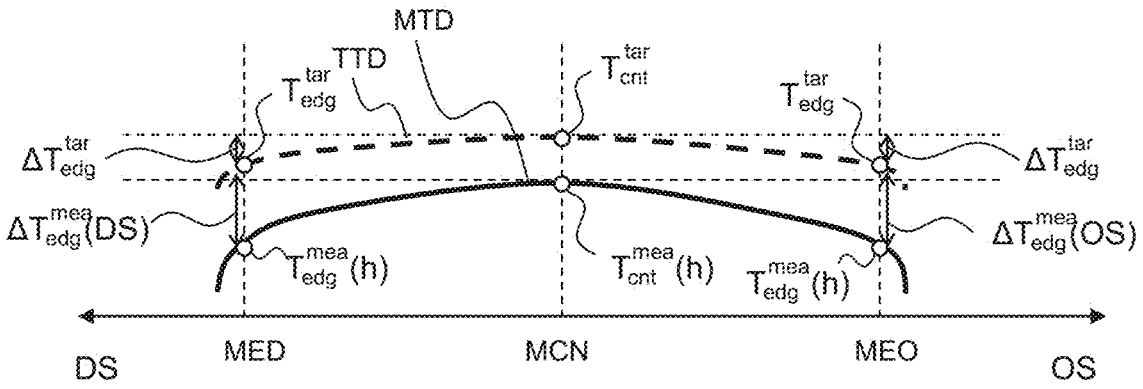
FIG. 11 is a diagram for illustrating an example of temperature distribution in a width direction of a segment (h)

FIG. 11 is a diagram for illustrating an example of temperature distribution in the width direction of the segment (h). The horizontal axis of FIG. 11 indicates the width direction of the segment (h). The horizontal axis includes the direction of the operation side (OS) and the direction of the drive side (DS). The solid line shown in FIG. 11 represents the measured value MTD of the temperature distribution. As can be understood from the measured value MTD, the temperature distribution from the central section to the edge section in the OS direction is substantially equal to the temperature distribution from the central section to the edge section in the DS direction. However, the temperature $T_M$ of the edge section is lower than the temperature $T_M$ of the central section. The reason for this is that thermal radiation from the side surface of the material M or the like has an influence.

In the first and second embodiments, control was performed focusing on the temperature $T_M$ of the material M in the longitudinal direction. On the other hand, in the third embodiment, the temperature $T_M$ in the width direction edge portion of the material M is controlled in addition to the temperature $T_M$ in the longitudinal direction. The broken line in FIG. 11 represents the target value TTD of the temperature distribution in the width direction of the material M passing through the installation position FE. The target value of the temperature $T_M$ in the control of the width direction edge portion is defined as a difference $\Delta T_{edg_FE}^{tar}$ between a target value of the temperature $T_M$ at the position MCN of the central section (hereinafter, also referred to as a "target temperature $T_{cnt_FE}^{tar}$") and a target value of the temperature $T_M$ at the position of the edge section (position MED or MEO) (hereinafter, also referred to as a "target temperature $T_{edg_FE}^{tar}$"). The difference $\Delta T_{edg_FE}^{tar}$ between the target values of the temperatures $T_M$ (hereinafter, also referred to as a "target temperature difference") is included in the operation instruction IOP. An example of the set-up calculation for controlling the temperature $T_M$ in the width direction edge portion will be described later.

3-3. Configuration Example of Control Device

In the third embodiment, the cooling equipment 2 is controlled as in the first embodiment. Therefore, the configuration of the control device 6 in the third embodiment is basically the same as that in the first embodiment. However, in the third embodiment, the set-up calculation, the learning calculation, and the FF control for controlling the temperature $T_M$ in the width direction edge portion are performed.

3-4. Example of Learning Calculation

In the learning calculation in the third embodiment, a temperature compensation value $\Delta T_{edg_FE}^{comp}$ in the width direction edge portion of the material M passing through the installation position FE is calculated. The temperature compensation value $\Delta T_{edg_FE}^{comp}$ is used to compensate for the target temperature difference $\Delta T_{edg_FE}^{tar}$ in the set-up calculation for material M (i+1). The temperature compensation value $\Delta T_{edg_FE}^{comp}$ is calculated based on the target temperature difference $\Delta T_{edg_FE}^{tar}$ and a measured temperature difference $\Delta T_{edg_FE}^{mea}$ Here, the measured temperature difference $\Delta T_{edg\text{-}FE}^{mea}$ is a difference between the central section measured temperature $T_{cnt_FE}^{mea}$ and an edge section measured temperature $T_{edg_FE}^{mea}$. The measured temperature difference $\Delta T_{edg_FE}^{mea}$ in the width direction edge portion of the segment (h) is calculated by Equation (26).

[Formula 26]

$$\Delta T_{edg_FE}^{mea}(h) = T_{cnt_FE}^{mea}(h) - T_{edg_FE}^{mea}(h) \tag{26}$$

In Equation (26), the edge section measured temperature $T_{edg_FE}^{mea}$ (h) is obtained from both positions MED and MEO. Therefore, for the calculation of Equation (26), the edge section measured temperature $T_{edg_FE}^{mea}$ (DS) (h) obtained in position MED may be used, the edge section measured temperature $T_{edg_FE}^{mea}$ (OS) (h) obtained in position MEO may be used, or the mean value of these may be used (Equation 27).

[Formula 27]

$$T_{edg_FE}^{mea}(h) = \left(T_{edg_FE}^{mea}(OS)(h) + T_{edg_FE}^{mea}(DS)(h)/2\right) \tag{27}$$

A temperature compensation value $\Delta T_{edg_FE}^{comp}$ (new) for the set-up calculation of the material M (i+1) is calculated based on Equation (28) using a temperature compensation value $\Delta T_{edg_FE}^{comp}$ (old) applied for the material M (i−1).

[Formula 28]

$$\Delta T_{edg_FE}^{comp}(new) = \alpha \cdot \left(\Delta T_{edg_FE}^{mea}(h) - \Delta T_{edg_FE}^{tar}\right) + \Delta T_{edg_FE}^{comp}(old) \tag{28}$$

In Equation (28), α represents a compensation gain.

When the temperature compensation value $\Delta T_{edg_FE}^{comp}$ (new) is calculated, the temperature compensation value $\Delta T_{edg_FE}^{comp}$ (new) is updated. However, when a flow amount measured value $Q_{edg}^{act}$ in the width direction edge portion of the coolant water for the position x of the material M includes a value that has reached the upper limit value or the lower limit value of the flow amount, the temperature compensation value $\Delta T_{edg_FE}^{comp}$ (new) is not updated.

3-5. Example of Set-Up Calculation

In the set-up calculation in the third embodiment, the flow amount set-up value Q(x) in the width direction edge portion (i.e., the flow amount set-up value $Q(x)_{edg}^{use}$) is changed by using the temperature compensation value $\Delta T_{edg_FE}^{comp}$. However, the difference in temperature of the temperature $T_M$ in the width direction edge portion varies depending on steel type and size, and also varies depending on heating modes of the material M by the additional devices and the use or non-use of the additional devices. Therefore, in the third embodiment, factors that affect the difference in temperature of the temperature $T_M$ in the width direction edge portion is managed as a reference temperature difference $\Delta T_{edg_FE}^{nom}$ (Equation 29).

[Formula 29]

$$\Delta T_{edg_FE}^{nom} = f(h, w, sg, t_{hc}, t_{cb}, t_{eh}) \tag{29}$$

The variables in Equation (29) are as follows (except for the variables already described).

h: Thickness[mm]

w: Plate width[mm]

sg: Steel type

The flow amount compensation value $Q_{edg}^{comp}$ in the width direction edge portion is calculated by Equation (30) based on the target temperature difference $\Delta T_{edg_FE}^{tar}$, the temperature compensation value $\Delta T_{edg_FE}^{comp}$, the reference temperature difference $\Delta T_{edg_FE}^{nom}$, and a flow amount-temperature change influence coefficient $Inf_{wdt}$ in the width direction edge portion.

[Formula 30]

$$Q_{edg_FE}^{comp} = Inf_{wdt} \cdot \left(\Delta T_{edg_FE}^{nom} - \Delta T_{edg_FE}^{tar} + \Delta T_{edg_FE}^{comp}\right) \tag{30}$$

The influence coefficient $Inf_{wdt}$ of Equation (30) represents a change in the temperature $T_M$ with respect to a change in the flow amount of the coolant water in the width direction edge portion. The influence coefficient $Inf_{wdt}$ may be calculated using the measured value as in the case of the influence coefficient $Inf_{cnt}$, or may be determined by a simulation in advance.

The change of the flow amount set-up value $Q(x)_{edg}^{use}$ is performed by the following formula (31) in which the flow amount compensation value $Q_{edg}^{comp}$ is added to the variable of Equation (15).

[Formula 31]

$$Q_{edg}^{comp}(x) = f(Q_{cnt}^{use}(x)) + Q_{edg}^{std}(x) - Q_{edg}^{comp}/X_{wtr} \tag{31}$$

The variable in Equation (31) is as follows.

$X_{wtr}$: Total length in a contact between the coolant water and the material to be rolled[m]

Note that the limit check using the upper limit $Q(x)_{edg}^{max}$ and the lower limit $Q(x)_{edg}^{min}$ is performed on the changed flow amount set-up value $Q(x)_{edg}^{use}$ (Equations (32) and (33)). This limit check is as described in step S28 of FIG. 5.

[Formula 32]

$$Q_{edg}^{use}(x) = \min\left(Q_{edg}^{use}(x), Q_{edg}^{max}(x)\right) \tag{32}$$

[Formula 33]

$$Q_{edg}^{use}(x) = \max\left(Q_{edg}^{use}(x), Q_{edg}^{min}(x)\right) \tag{33}$$

3-6. Example of FF Control

In the FF control in the first embodiment, the flow amount standard value of the coolant water in the cooling equipment 2 was calculated for each point of the material M such that the target temperature pattern $T_{TBD}^{tar}$ (i) that is set over the whole length of the material M was achieved based on the flow amount set-up value Q(x) and the like. In the FF control in the third embodiment, the flow amount set-up value Q(x) is applied to the width direction central portion of the material M, and the flow amount set-up value $Q(x)_{edg}^{use}$ is applied to the width direction edge portion of the material M, thereby setting the target temperature pattern $T_{TBD}^{tar}$ (i). Then, the flow amount standard value of the coolant water in the cooling equipment 2 is determined for each segment such that the target temperature pattern $T_{TBD}^{tar}$ (i) is achieved. The segment (h) is set in the longitudinal direction of the material M. Therefore, for example, when the segment (h) is divided into three in the width direction, the flow amount standard value of the central section in the width direction and the flow amount standard value of the edge sections in the OS direction and the DS direction can be determined.

3-7. Effect

According to the third embodiment described above, the flow amount set-up value Q is changed in the width direction edge portion. Therefore, the measured temperature difference $\Delta T_{edg\text{-}FE}^{mea}$ can be made to coincide with the target temperature difference $\Delta T_{edg\text{-}FE}^{tar}$. This makes it possible to match the measured temperature $T_{FE}^{mea}$ with the target temperature $T_{FE}^{tar}$ not only in the longitudinal direction but also in the width direction.

4. Fourth Embodiment

A fourth embodiment will be described with reference to FIG. 12. Note that the description of the configuration and function common to the embodiment mentioned above will be omitted as appropriate.

4-1. Configuration Example of Hot Rolling Line

Figure 12:
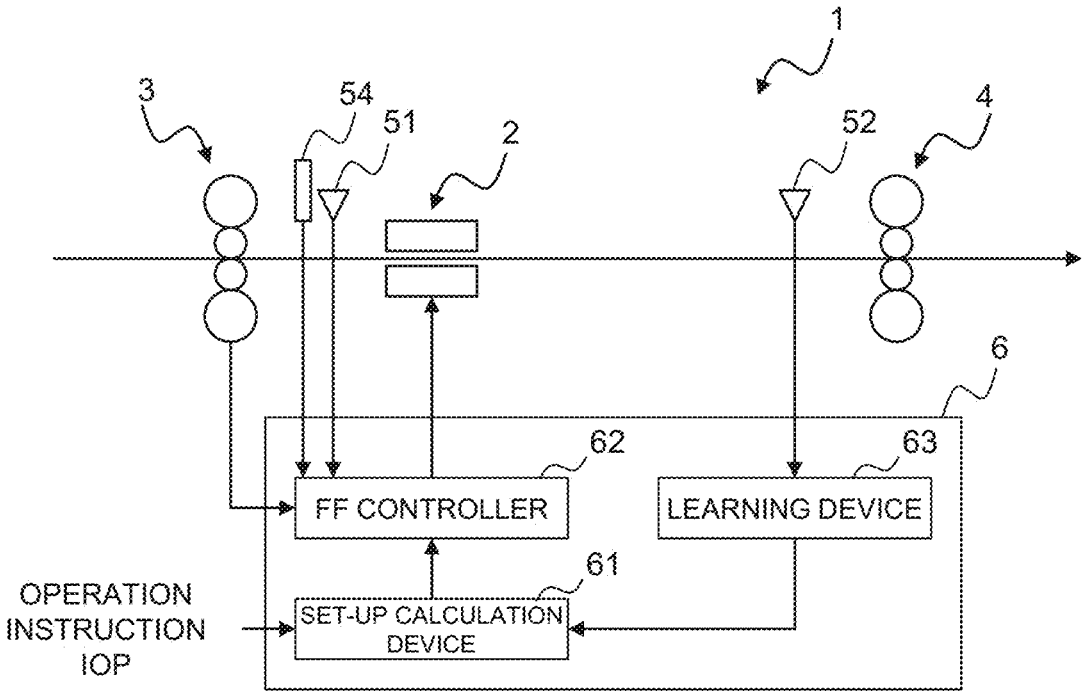
FIG. 12 is a diagram for illustrating a configuration example of a hot rolling line to which a fourth embodiment is applied.

FIG. 12 is a diagram for illustrating a configuration example of a hot rolling line to which the fourth embodiment is applied. In the example shown in FIG. 12, a scan pyrometer 54 is provided in the vicinity of the rougher delivery-side pyrometer 51. The scan pyrometer 54 is included in various measuring equipment provided in the hot rolling line 1. The scan pyrometer 54 measures, for example, a temperature distribution in the width direction of the material M passing through the installation position RD (see FIG. 2) or the vicinity thereof. The scan pyrometer 54 is an example of a "rougher delivery-side temperature distribution meter" in the present disclosure.

The temperature distribution in the width direction includes a measured value of the temperature $T_M$ in the central section (hereinafter referred to as a "width direction central section temperature measured value $T_{cnt_RD}^{rmea}$" or a "central section measured temperature $T_{cnt_RD}^{mea}$") and a measured value of the temperature $T_M$ in the edge section (hereinafter referred to as a "width direction edge section temperature measured value $T_{edg_RD}^{mea}$" or an "edge section measured temperature $T_{edg_RD}^{mea}$"). The central section measured temperature $T_{cnt_RD}^{mea}$ and the edge section measured temperature $T_{edg_RD}^{mea}$ are transmitted to the control device 6.

4-2. Feature of Fourth Embodiment

As in the third embodiment, in the fourth embodiment, the temperature $T_M$ in the width direction edge portion is controlled. The difference between the third embodiment and the fourth embodiment is the setting position of the target temperature difference in the width direction. That is, in the former case, the target temperature difference (i.e., the target temperature difference $\Delta T_{edg_FE}^{tar}$) is set for the installation position FE, but in the latter case, the target temperature difference is set for the installation position RD. To be specific, in the fourth embodiment, a difference $\Delta T_{edg_RD}^{tar}$ between a target value (hereinafter, also referred to as a "target temperature $T_{cnt_RD}^{tar}$") of the temperature $T_M$ at the position MCN of the central section and a target value (hereinafter, also referred to as a "target temperature $T_{edg_RD}^{tar}$") of the temperature $T_M$ at the position (position MED or MEO) of the edge section is set. The target temperature difference $\Delta T_{edg_RD}^{tar}$ is included in the operation instruction IOP.

4-3. Configuration Example of Control Device

As in the third embodiment, in the fourth embodiment, the set-up calculation, the learning calculation, and the FF control for controlling the temperature $T_M$ in the width direction edge portion are performed.

4-4. Example of Learning Calculation

In the learning calculation in the fourth embodiment, a temperature compensation value $\Delta T_{edg_RD}^{comp}$ in the width direction edge portion of the material M passing through the installation position RD is calculated. The temperature compensation value $\Delta T_{edg_RD}^{comp}$ is used to compensate for a target temperature difference $\Delta T_{edg_RD}^{tar}$ in the set-up calculation for the material M (i+1). The temperature compensation value $\Delta T_{edg_RD}^{comp}$ is calculated based on the target temperature difference $\Delta T_{edg_RD}^{tar}$ and a measured temperature difference $\Delta T_{edg_RD}^{mea}$. Here, the measured temperature difference $\Delta T_{edg_RD}^{mea}$ is the difference between the central section measured temperature $T_{cnt\text{-}RD}^{mea}$ and the edge section measured temperature $T_{edg\text{-}RD}^{mea}$. The measured temperature difference $\Delta T_{edg_RD}^{mea}$ in the width direction edge portion of the segment (h) is calculated by Equation (34).

[Formula 34]

$$\Delta T_{edg_RD}^{mea}(h) = T_{cnt_RD}^{mea}(h) = T_{edg_RD}^{mea}(h) \tag{34}$$

In Equation (34), the edge section measured temperature $T_{edg_RD}^{mea}$ (h) is obtained from both positions MED and MEO. Therefore, for the calculation of Equation (34), the edge section measured temperature $T_{edg_RD}^{mea}$ (DS) (h) obtained in position MED may be used, the edge section measured temperature $T_{edg_RD}^{mea}$ (OS) (h) obtained in position MEO may be used, or a mean value of these may be used.

A temperature compensation value $\Delta T_{edg_RD}^{comp}$ (new) for the set-up calculation of material M (i+1) is calculated using the temperature compensation value $\Delta T_{edg_RD}^{comp}$ (old) applied to material M (i−1). This calculation formula is described by replacing "$\Delta T_{edg_FE}^{comp}$" with "$\Delta T_{edg_RD}^{comp}$" in Equation (28).

When the temperature compensation value $\Delta T_{edg_RD}^{comp}$ (new) is calculated, the temperature compensation value $\Delta T_{edg_RD}^{comp}$ (new) is updated. However, when the flow amount measured value $Q_{edg}^{act}$ in the width direction edge portion of coolant water for position x of material M includes a value that has reached the upper limit value or the lower limit value of the flow amount, the temperature compensation value $\Delta T_{edg_RD}^{comp}$ (new) is not updated.

4-5. Example of Set-Up Calculation

In the set-up calculation in the fourth embodiment, the flow amount set-up value Q(x) in the width direction edge portion (i.e., the flow amount set-up value $Q(x)_{edg}^{use}$) is changed by using the temperature compensation value $\Delta T_{edg_RD}^{comp}$. The set-up calculation in the fourth embodiment is basically the same as that in the third embodiment. However, since there is a difference in the setting position of the target value between these embodiments, the variable of the reference temperature difference $\Delta T_{edg_RD}^{nom}$ does not include the variable related to the additional device included as the variable of Equation (29).

4-6. Example of FF Control

An example of the FF control in the fourth embodiment is the same as that of the FF control in the third embodiment.

4-7. Effect

According to the fourth embodiment described above, the flow amount set-up value Q is changed in the width direction edge portion. Therefore, when a large difference in temperature is generated between the central section and the edge section of the material M in the width direction at the entry side of the rougher mill 3, the difference in temperature can be matched with the target temperature difference $\Delta T_{edg_RD}^{tar}$ at the installation position RD at the delivery side of the rougher mill 3.

5. Fifth Embodiment

A fifth embodiment will be described with reference to FIG. 13. Note that the description of the configuration and function common to the embodiment mentioned above will be omitted as appropriate.

Figure 13:
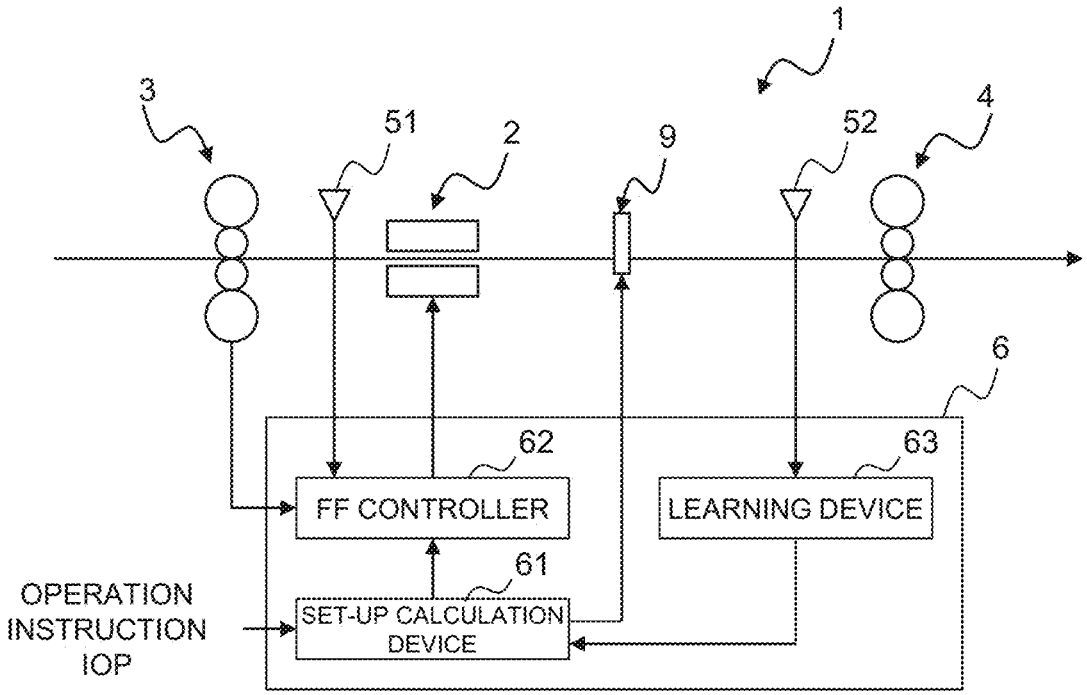
FIG. 13 is a diagram for illustrating a configuration example of a hot rolling line to which a fifth embodiment is applied.

FIG. 13 is a diagram for illustrating a configuration example of a hot rolling line to which the fifth embodiment is applied. In the example shown in FIG. 13, an induction heating device 9 is provided between the rougher mill 3 and the finisher mill 4. The configuration example in which the induction heating device 9 is installed is the same as the configuration example shown in FIG. 9.

In the set-up calculation of the first embodiment, when the prediction temperature $T_{FE}^{pre}$ is lower than the target temperature $T_{FE}^{tar}$, the cooling of the material M by the cooling equipment 2 is not performed (see step S14 of FIG. 4). In the fifth embodiment, in such a case, the material M is heated by the induction heating device 9 to raise the temperature $T_M$. In detail, when the prediction temperature $T_{FE}^{pre}$ is determined to be lower than the target temperature $T_{FE}^{tar}$, the control device 6 (the set-up calculation device 61) transmits an operation instruction to the induction heating device 9 such that the segment with the low temperature is heated. When the induction heating device 9 is operated in accordance with the operation instruction, the measured temperature $T_{FE}^{mea}$ can be increased, and thus the measured temperature $T_{FE}^{mea}$ can be matched with the target temperature $T_{FE}^{tar}$. In this case, since the cooling equipment 2 is not used, the learning value $\Delta T_{TBD}^{ofs}$ is not updated.

6. Sixth Embodiment

A sixth embodiment will be described with reference to FIG. 14. Note that the description of the configuration and function common to the embodiment mentioned above will be omitted as appropriate.

Figure 14:
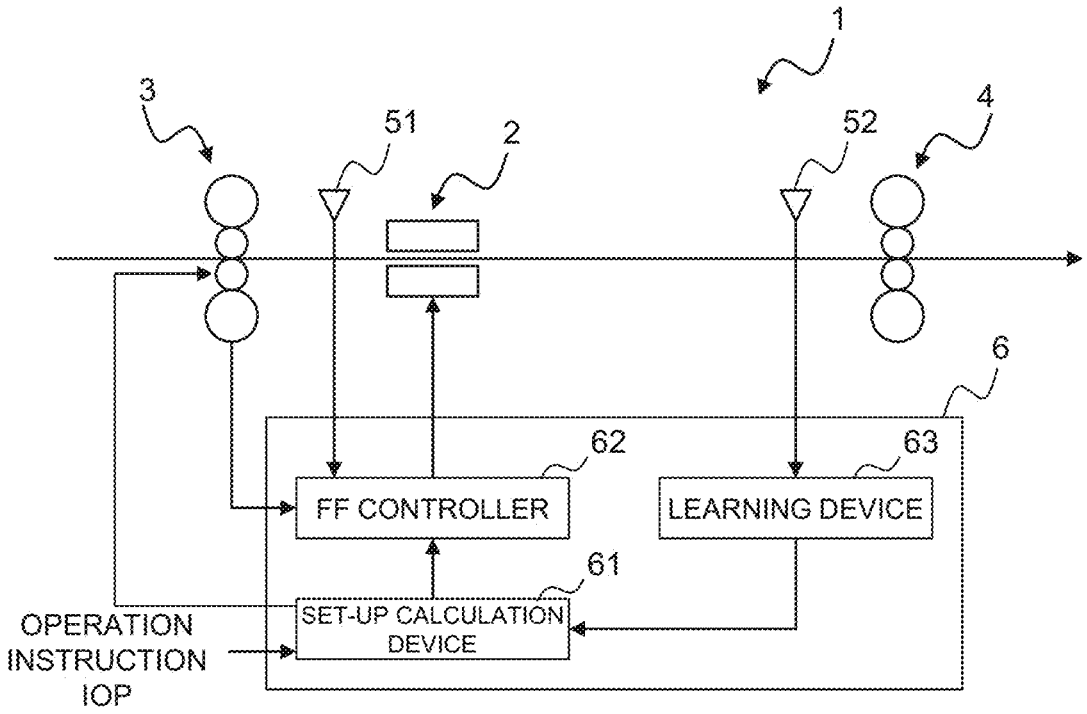
FIG. 14 is a diagram for illustrating a configuration example of a hot rolling line to which a sixth embodiment is applied.

FIG. 14 is a diagram for illustrating a configuration example of a hot rolling line to which the sixth embodiment is applied. The example shown in FIG. 14 is basically the same as the configuration example shown in FIG. 1.

In the set-up calculation of the first embodiment, when the positive determination result is obtained in the processing of step S32 of FIG. 5 (in the first case), the upper limit of the flow amount set-up value Q(x) is adopted as the flow amount set-up value Q(x). However, the fact that the upper limit of the flow amount set-up value Q(x) is adopted means that the prediction temperature $T_{TBD}^{pre}$ is higher than the target temperature $T_{TBD}^{tar}$. Therefore, when the upper limit of the flow amount set-up value Q(x) is adopted, the measured temperature $T_{TBD}^{mea}$ may not be matched with the target temperature $TT_{BD}^{tar}$.

Therefore, in the sixth embodiment, when the flow amount set-up value Q(x) exceeds the upper limit, the rollback rolling velocity is decreased. In detail, when the upper limit of the flow amount set-up value Q(x) is adopted as the flow amount set-up value Q(x), the set-up calculation device 61 decreases the rougher rolling velocity to velocity lower than the velocity $v_{RM}^{run}$ (see FIG. 3). The reason for this is that, in general, the measured temperature $T_{TBD}^{mea}$ is the highest temperature of the tip end section of the material M, and therefore, the measured temperature $T_{TBD}^{mea}$ is decreased by lowering the roll rolling velocity to lower the temperature of the tip end section. However, when the manipulation condition does not permit the change of the rougher rolling velocity, the rougher rolling velocity is not changed.

In the set-up calculation of the sixth embodiment, the temperature drop calculation of the material M when the material M is transported from the installation position RD to the target position TBD is performed based on the velocity pattern including the velocity lower than the velocity $v_{RM}^{run}$, that is, the slower rolling velocity (Equation (1)). If the difference between the prediction temperature $T_{TBD}^{pre}$ and the target temperature $T_{TBD}^{tar}$ is equal to or less than the allowable value, the temperature drop calculation is terminated. Otherwise, the rougher rolling velocity is changed to a velocity lower than the velocity vRMrun. In order to maintain stability of the rougher rolling and the manipulation form as much as possible, the rougher approaching velocity and the conveying velocity are not changed. In addition, when the greater rolling velocity is changed, a lower limit value is provided for the greater rolling velocity after the change such that the greater rolling velocity does not become lower than the greater approaching velocity (i.e., the velocity $v_{RM}^{thd}$). By changing the velocity pattern within the range of the constraint, the measured temperature $T_{TBD}^{mea}$ can be controlled to be close to the target temperature $T_{TBD}^{tar}$.

7. Seventh Embodiment

A seventh embodiment will be described with reference to FIGS. 15 to 17. Note that the description of the configuration and function common to the embodiment mentioned above will be omitted as appropriate.

The seventh embodiment is based on a configuration example in which the coil box 8 is installed between the rougher mill 3 and the finisher mill 4. The configuration example in which the coil box 8 is installed includes the configuration example shown in FIG. 9.

Figure 15:
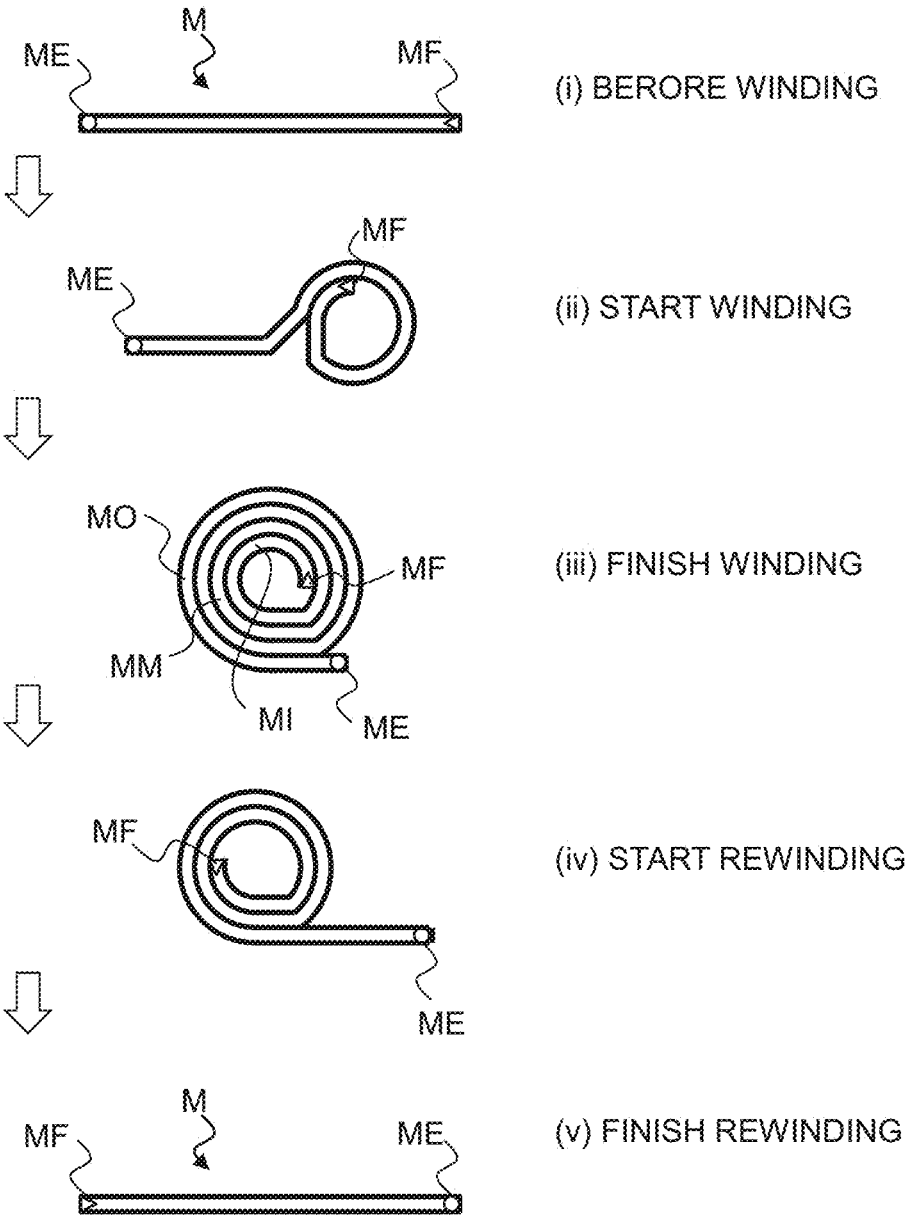
FIG. 15 is a diagram for illustrating an example of winding and rewinding of the material to be rolled by a coil box.

FIG. 15 is a diagram for illustrating an example of winding and rewinding of the material M by the coil box 8. FIG. 15 (i) to 15 (iii) show a change in shape of the material M during winding. FIG. 15 (iv)-(v) show a change in the shape of the material M during rewinding. As can be understood from FIG. 15 (i) to (v), the positions of the tip end section MF and the tail end section ME of the material M are switched before and after the winding. In addition, a heat retention effect while the material M is wound in a coil shape is greatly different among an innermost circumference section MI, an outermost circumference section MO, and a central section MM.

Therefore, in the seventh embodiment, when the coil box 8 is used, the target temperature $T_{TBD}^{tar}$ is set for each of the innermost circumference section MI, the outermost circumference section MO, and the central section MM. In the set-up calculation of the seventh embodiment, first, the temperature drop calculation of the material M when the material M is conveyed from the installation position RD to the target position TBD is performed, and the target temperature $T_{TBD}^{tar_MM}$ for the central section MM is determined. This target temperature $T_{TBD}^{tar_MM}$ is set as a target temperature $T_{TBD}^{asi}$ (Equation (35)).

[Formula 35]

$$T_{TBD}^{tar_MM} = T_{TBD}^{asi} \tag{35}$$

A target temperature $T_{TBD}^{tar_MO}$ for the outermost circumference section MO and a target temperature $T_{TBD}^{tar_MI}$ for the innermost circumference section MI are determined as follows by using the target temperature $T_{TBD}^{asi}$ (Equations (36) and (37)).

[Formula 36]

$$T_{TBD}^{tar_MO} = T_{TBD}^{asi} + \Delta T_{MO} \tag{36}$$

In Equation (36), $\Delta T_{MO}$ represents a temperature drop amount due to heat radiation from the outermost circumference section MO. The temperature drop amount $\Delta T_{MO}$ is given as a constant based on the steel type and size of the material M, and is arbitrarily determined.

[Formula 37]

$$T_{TBD}^{tar_MI} = T_{TBD}^{asi} + \Delta T_{MI} \tag{37}$$

In Equation (37), $\Delta T_{MI}$ represents a temperature drop amount due to heat radiation from the innermost circumference section MI. The temperature drop amount $\Delta T_{MI}$ is arbitrarily determined as in the temperature drop amount $\Delta T_{MO}$.

The temperature drop amounts $\Delta T_{MO}$ and $\Delta T_{MI}$ can be obtained by the following Equations (38) and (39), respectively, in consideration of heat radiation, assuming that the outermost circumference section MO and the innermost circumference section MI are cooled more easily than the central section MM because they are in contact with air.

[Formula 38]

$$\Delta T_{MO} = \int_0^{t_{MO}} f(T_M(t), \sigma, \varepsilon, \rho, \varphi(T_M(t)))dt \tag{38}$$

In Equation (38), $t_{MO}$ is a time from the start of winding to the start of rewinding with respect to the outermost circumference section MO.

[Formula 39]

$$\Delta T_{MI} = \int_0^{t_{MI}} f(T_M(t), \sigma, \varepsilon, \rho, \varphi(T_M(t)))dt \tag{39}$$

In Equation (39), $t_{MI}$ is a time from the start of winding to the start of rewinding with respect to the innermost circumference section MI.

In the FF control in the seventh embodiment, the pattern of the target temperature $T_{TBD}^{tar}$ is changed according to a position y with the tail end of the coiled material M as a reference. When the lengths of the outermost circumference section MO and the innermost circumference section MI are $L_{MO}$ and $L_{MI}$, respectively, the target temperature pattern $T_{TBD}^{tar}(i)$ is set by Equation (40) when position y is $y \le L_{MO}$, by Equation (41) when position y is $L_{MO} < y < L_{bar} - L_{MI}$, and by Equation (42) when position y is $y \ge L_{bar} - L_{MI}$.

[Formula 40]

$$T_{TBD}^{tar}(i) = T_{TBD}^{tar_MO} + \Delta T_{CH} \cdot \frac{y}{L_{bar}} \tag{40}$$

[Formula 41]

$$T_{TBD}^{tar}(i) = T_{TBD}^{tar_MM} + \Delta T_{CH} \cdot \frac{y}{L_{bar}} \tag{41}$$

[Formula 42]

$$T_{TBD}^{tar}(i) = T_{TBD}^{tar_MI} + \Delta T_{CH} \cdot \frac{y}{L_{bar}} \tag{42}$$

Figure 16:
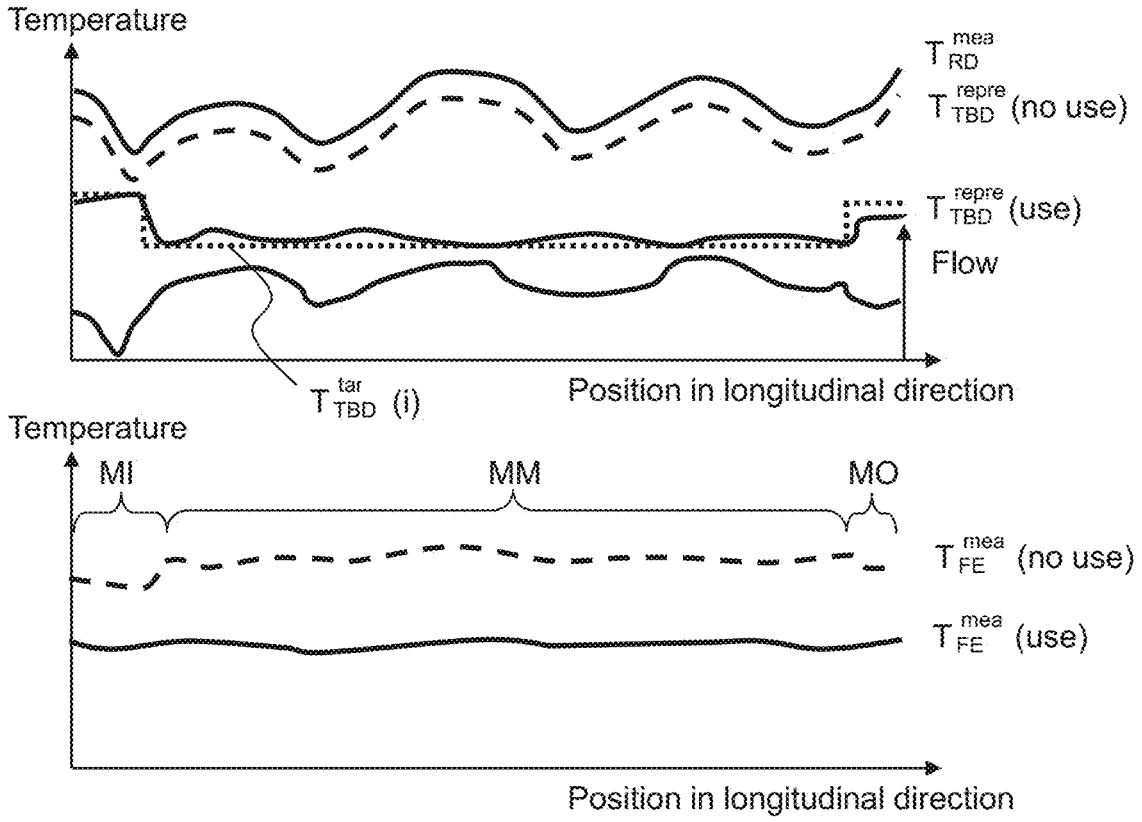
FIG. 16 is a diagram showing an example of a result of control by a seventh embodiment.
Figure 17:
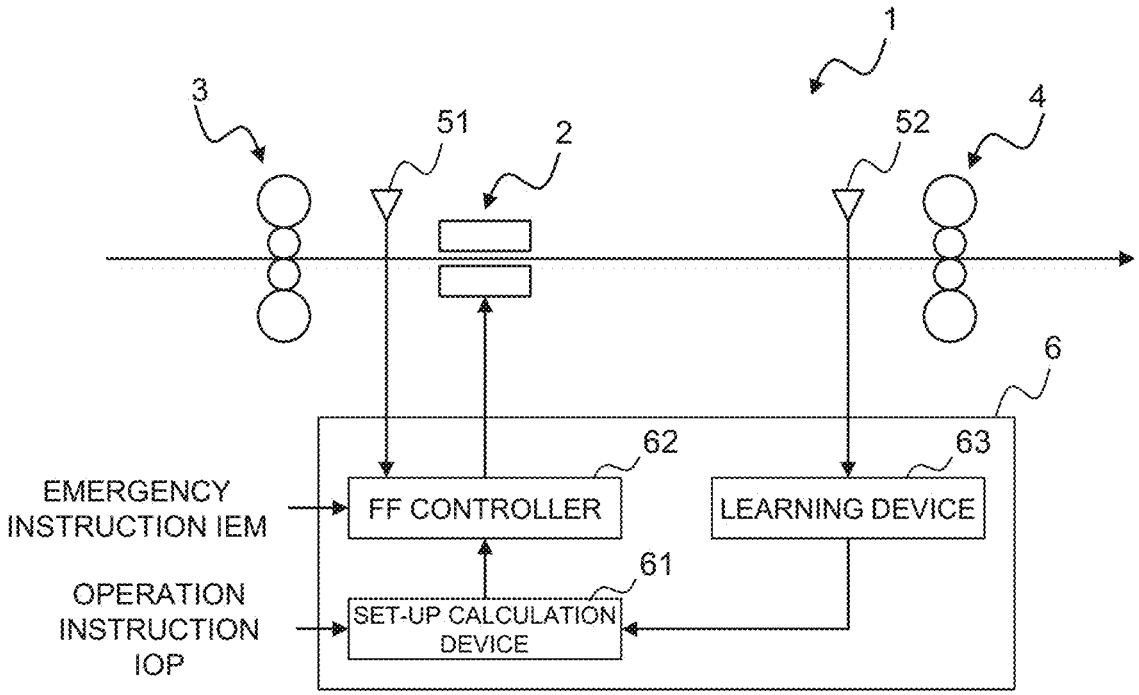
FIG. 17 is a diagram for illustrating a configuration example of a hot rolling line to which a ninth embodiment is applied.

FIG. 16 is a diagram for illustrating an example of a result of control according to the seventh embodiment. In the example shown in FIG. 16, the coil box 8 is used. In the upper part of FIG. 16, the transition of the measured temperature $T_{RD}^{mea}$ and the transition of two kinds of re-prediction temperature $T_{TBD}^{repre}$ are depicted. The re-prediction temperature $T_{TBD}^{repre}$ is as described in the upper part of FIG. 7. As can be understood from the comparison between the two kinds of measured temperatures $T_{FE}^{mea}$ shown in the lower part of FIG. 16 and the two kinds of measured temperatures $T_{FE}^{mea}$ shown in the middle part of FIG. 7, the temperature of the central section MM of the material M is constant when the coil box 8 is used. This is due to soaking by heat retention and contact heat transfer, and the same phenomenon is observed not only when control is performed according to the seventh embodiment (use) but also when only air cooling is performed (no use).

However, as can be understood from the comparison with the two types of measured temperatures $T_{FE}^{mea}$ shown in the lower part of FIG. 16, when the control according to the seventh embodiment is performed (use), the measured temperature $T_{FE}^{mea}$ is constant over the whole length of the material M. This is because the flow amount set-up value Q is determined such that the target temperatures $T_{TBD}^{tar_MO}$ and $T_{TBD}^{tar_MI}$ are higher than the target temperature $T_{TBD}^{tar_MM}$.

8. Eighth Embodiment

An eighth embodiment will be described. Note that the description of the configuration and function common to the embodiment mentioned above will be omitted as appropriate.

In the third or fourth embodiment, after the flow amount set-up value $Q(x)_{deg}^{use}$ in the width direction edge portion is set, a lower bound check on the flow amount set-up value $Q(x)_{edg}^{use}$ is performed using Equation (33). In this lower bound check, if the flow amount set-up value $Q(x)_{edg}^{use}$ is less than the lower bound $Q(x)_{edg}^{min}$, the flow amount set-up value $Q(x)_{edg}^{use}$ is changed to the lower bound $Q(x)_{edg}^{min}$. However, the flow amount set-up value $Q(x)_{edg}^{use}$ being changed to the lower limit $Q(x)_{edg}^{min}$ means that the measured temperature difference $\Delta T_{edg\text{-}FE}^{mea}$ is in a situation of being larger than the target temperature difference $\Delta T_{edg\text{-}FE}^{tar}$. Therefore, when the lower limit $Q(x)_{edg}^{min}$ is adopted, the measured temperature difference $\Delta T_{edg\text{-}FE}^{mea}$ may not be matched with the target temperature difference $\Delta T_{edg\text{-}FE}^{tar}$.

Therefore, in the set-up calculation of the eighth embodiment, when the flow amount set-up value $Q(x)_{edg}^{use}$ is smaller than the lower limit $Q(x)_{edg}^{min}$, the target temperature $T_{TBD}^{tar}$ is decreased. The flow amount set-up value $Q(x)_{edg}^{use}$ is calculated using the flow amount set-up value $Q(x)_{cnt}^{use}$, and the flow amount set-up value $Q(x)_{cnt}^{use}$ is calculated based on the target temperature $T_{TBD}^{tar}$. Therefore, if the target temperature $T_{TBD}^{tar}$ is decreased, the flow amount set-up values $Q(x)_{cnt}^{use}$ and $Q(x)_{edg}^{use}$ are also decreased. Therefore, it is possible to prevent the flow amount set-up value $Q(x)_{edg}^{use}$ from falling below the lower limit $Q(x)_{edg}^{min}$.

In the set-up calculation of the eighth embodiment, the temperature drop calculation of the material M is performed when the material M is transported from the installation position RD to the target position TBD after the target temperature $T_{TBD}^{tar}$ is changed (see Equation (1)). Also, the flow amount set-up values $Q(x)_{cnt}^{use}$ and $Q(x)_{edg}^{use}$ are calculated (see Equation (31)), and a lower bound check on the flow amount set-up value $Q(x)_{edg}^{use}$ is performed (see Equation (33)). If the difference between the flow amount set-up value $Q(x)_{edg}^{use}$ and the lower limit $Q(x)_{edg}^{min}$ is equal to or less than the allowable value, the calculation is terminated. This makes it possible to make the measured temperature difference $\Delta T_{edg\text{-}FE}^{mea}$ coincide with the target temperature difference $\Delta T_{edg\text{-}FE}^{tar}$.

9. Ninth Embodiment

A ninth embodiment will be described with reference to FIG. 17. Note that the description of the configuration and function common to the embodiment mentioned above will be omitted as appropriate.

When some abnormality occurs in the finisher mill 4, the material M may not be conveyed to the finisher mill 4. This problem may also occur when some abnormality occurs in the equipment downstream of the finisher mill 4. When such an abnormality occurs, the material M needs to be oscillated before the finisher mill 4. However, in this case, the temperature of the material M is inevitably lowered. Therefore, in the ninth embodiment, when the control device 6 receives the emergency instruction IEM for notifying the occurrence of the abnormality, the cooling by the cooling equipment 2 is stopped.

Depending on a length $L_{bar}$ of the material M, a part of the material M may remain at the position of the cooling equipment 2 due to oscillation before the finisher mill 4. Therefore, particularly when the oscillation of the material M having a long length $L_{bar}$ is performed, it is desirable to stop the cooling by the cooling equipment 2. To stop cooling as soon as possible, when the control device 6 receives the emergency instruction IEM, the FF controller 62 immediately sets the flow amount standard value of the cooling equipment 2 to zero. Thus, the cooling by the cooling equipment 2 is stopped, and the temperature of the material M can be prevented from being lowered by the cooling.

REFERENCE SIGNS LIST

1 . . . Hot rolling line, 2 . . . Cooling equipment, 3 . . . Rougher mill, 4 . . . Finisher mill, 51 . . . Rougher delivery-side pyrometer, 52 . . . Finisher entry-side pyrometer, 53,54 . . . Scan pyrometer, 6 . . . Control device, 61 . . . Set-up calculation device, 62 . . . FF controller, 63 . . . Learning device, FE, RD . . . Installation position, TBD . . . Target position, M . . . Material to be rolled, ME . . . Tail end section, MF . . . Tip end section, MI . . . Innermost circumference section, MM . . . Central section, MO . . . Outermost circumference section, $T_M$ . . . Temperature of Material to be rolled, $T_{FE}^{mea}$ . . . Finisher entry-side temperature measured value (measured temperature), $T_{FE}^{tar}$ . . . Finisher entry-side temperature target value (target temperature), $T_{FE}^{pre}$ . . . Finisher entry-side temperature prediction value (prediction temperature), $T_{FE}^{repre}$ . . . Finisher entry-side temperature re-predicted value (re-prediction temperature), $T_{RD}^{mea}$ . . . Rougher delivery-side temperature measured value (measured temperature), $T_{TBD}^{tar}$ . . . Cooling equipment delivery-side temperature target value (measured temperature), $T_{TBD}^{pre}$ . . . Cooling equipment delivery-side temperature prediction value (prediction temperature), $T_{TBD}^{repre}$ . . . Cooling equipment delivery-side temperature re-prediction value (re-prediction temperature), $T_{TBD}^{tar_MI}$ . . . Target temperature for innermost circumference section, $T_{TBD}^{tar_MM}$ . . . Target temperature for central section target temperature, $T_{TBD}^{tar_MO}$ . . . Target temperature for outermost circumference section, $\Delta T_{TBD}^{ofs}$ . . . Learning value, $\Delta T_{edg_FE}^{comp}$ . . . Temperature compensation value, $\Delta T_{edg_FE}^{tar}$ . . . Difference between target temperatures in width direction of material to be rolled (target temperature difference), $\Delta T_{edg_FE}^{mea}$ . . . Measured temperature difference, $Q_{cnt}^{std}$ . . . Flow amount standard value, $Q_{edg}^{comp}$ . . . Flow amount compensation value, $T_{TBD}^{tar}$ . . . target temperature pattern

The invention claimed is:

1. A system for controlling temperature of a material to be rolled in a hot rolling line, the hot rolling line including a rougher mill for performing a reverse rolling, a finisher mill for performing a tandem rolling, an intermediate equipment group provided between the rougher mill and the finisher mill, a rougher delivery-side pyrometer provided between the rougher mill and the intermediate equipment group, a finisher entry-side pyrometer provided between the finisher mill and the intermediate equipment group, and a control device, wherein the intermediate equipment group includes a cooling equipment for cooling the material to be rolled using coolant water, wherein the control device comprises:

a set-up calculation device configured to determine a flow amount set-up value of the coolant water in the cooling equipment;

a feedforward control device configured to perform feedforward control of the flow amount of the coolant water in the cooling equipment based on the flow amount set-up value; and a learning device configured to calculate a learning value based on a flow amount measured value of the coolant water in the cooling equipment and a finisher entry-side temperature measured value indicating a measured value of temperature of the material to be rolled measured by the finisher entry-side pyrometer, wherein the set-up calculation device is configured to:

determine a finisher entry-side temperature target value indicating a target value of the temperature of the material to be rolled at an entry side of the finisher mill before a final pass of the reverse rolling on the material to be rolled is performed;

calculate a cooling equipment delivery-side temperature target value indicating a target value of the temperature of the material to be rolled at a delivery side of the cooling equipment for a finisher entry-side temperature prediction value indicating a predicted value of the temperature of the material to be rolled at the entry side of the finisher mill to match the finisher entry-side temperature target value; and determine the flow amount set-up value based on the cooling equipment delivery-side temperature target value and the learning value, wherein the feedforward control device is configured to:

determine a target temperature pattern indicating a pattern of target values of the temperature of the material to be rolled over whole length of the material to be rolled at the delivery side of the cooling equipment; and calculate flow amount standard values of the coolant water in the cooling equipment for each point in a longitudinal direction of the material to be rolled based on the flow amount set-up value, velocity information of the rougher mill, and a rougher delivery-side temperature measured value indicating a measured value of the temperature of the material to be rolled measured by the rougher delivery-side pyrometer, wherein the flow amount standard values are calculated such that a temperature prediction value of the delivery side of the cooling equipment indicating a predicted value of the temperature of the material to be rolled at the delivery side of the cooling equipment is consistent with the target temperature pattern, wherein the feedforward control device is further configured to:

perform the feedforward control such that flow amounts of the coolant water in the cooling equipment when each point of the material to be rolled reaches position to be cooled by the cooling equipment are respectively consistent with the flow amount standard values calculated for each point of the material to be rolled, wherein the learning device is configured to calculate the learning value based on a difference between the finisher entry-side temperature measured value and a finisher entry-side temperature re-prediction value indicating a re-prediction value of the temperature of the material to be rolled at the entry side of the finisher mill, wherein the finisher entry-side temperature re-prediction value is calculated based on the flow amount measured value, the rougher delivery-side temperature measured value, and an actual velocity of the material to be rolled.

2. The system according to claim 1, wherein the intermediate equipment group further comprises a heat-retention device for maintaining a temperature of the material to be rolled, and a heating device for heating the material to be rolled, wherein the set-up calculation device is further configured to:

calculate the cooling equipment delivery-side temperature target value based on the operation set-up values of the heat-retention device and the heating device, wherein the learning device is further configured to:

calculate the finisher entry-side temperature re-prediction value based on the flow amount measured value, the rougher delivery-side temperature measured value, the actual velocity of the material to be rolled, and operation results of the heat-retention device and the heating device.

3. The system according to claim 1, further comprising a finisher entry-side temperature distribution meter provided between the finisher mill and the intermediate equipment group and configured to measure a temperature distribution in a width direction of the material to be rolled, wherein the learning device is further configured to:

calculate a temperature compensation value indicating a compensation value of the temperature of an edge section of the width direction with respect to the temperature of a central section of the width direction at the delivery side of the rougher mill based on a difference between a target value difference indicating a difference between a target value of the temperature of the material to be rolled in the central section of the width direction and a target value of the temperature of the material to be rolled in the edge section of the width direction, and a measured value difference indicating a difference between a measured value of the temperature of the material to be rolled in the central section of the width direction and a measured value of the temperature of the material to be rolled in the edge section of the width direction, the measured value difference being calculated based on the temperature distribution; and wherein the set-up calculation device is further configured to:

determine a flow amount compensation value indicating a compensation value of a flow amount of the coolant water in the cooling equipment in the edge section by using the target value difference and the temperature compensation value; and determine a flow amount set-up value in the edge section based on the flow amount compensation value and the flow amount set-up value determined based on the cooling equipment delivery-side temperature target value and the learning value, wherein the feedforward control device is further configured to:

perform feedforward control on the flow amount of the coolant water in the edge section based on the flow amount set-up value in the edge section.

4. The system according to claim 1, further comprising a rougher delivery-side temperature distribution meter provided between the rougher mill and the intermediate equipment group and configured to measure a temperature distribution of the material to be rolled in a width direction, wherein the learning device is further configured to:

calculate a temperature compensation value indicating a compensation value of the temperature of an edge section of the width direction with respect to the temperature of a central section of the width direction at the delivery side of the rougher mill based on a difference between a target value difference indicating a difference between a target value of the temperature of the material to be rolled in the central section of the width direction and a target value of the temperature of the material to be rolled in the edge section of the width direction, and a measured value difference indicating a difference between a measured value of the temperature of the material to be rolled in the central section of the width direction and a measured value of the temperature of the material to be rolled in the edge section of the width direction, the measured value difference being calculated based on the temperature distribution, wherein the set-up calculation device is further configured to:

determine a flow amount compensation value indicating a compensation value of a flow amount of the coolant water in the cooling equipment in the edge section by using the target value difference and the temperature compensation value; and determine a flow amount set-up value in the edge section based on the flow amount compensation value and the flow amount set-up value determined based on the cooling equipment delivery-side temperature target value and the learning value, wherein the feedforward control device is further configured to:

perform feedforward control on the flow amount of the coolant water in the edge section based on the flow amount set-up value in the edge section.

5. The system according to claim 1, wherein the intermediate equipment group further comprises a heating device for heating the material to be rolled, wherein the set-up calculation device is further configured to:

send an operation instruction to the heating device when the finisher entry-side temperature prediction value is lower than the finisher entry-side temperature target value.

6. The system according to claim 1, wherein the set-up calculation device is further configured to:

change the velocity of the material to be rolled during rolling by the rougher mill to a velocity lower than a set-up velocity when the flow amount set-up value used for calculating the finisher entry-side temperature prediction value is greater than an upper limit.

7. The system according to claim 1, wherein the intermediate equipment group includes a coil box configured to maintain a temperature of the material to be rolled, wherein the set-up calculation device is configured to:

set the cooling equipment delivery-side temperature target value for each of an innermost circumference section, an outermost circumference section, and a central section of the material to be rolled wound in a coil shape by the coil box; and determine the flow amount set-up value for each of the innermost circumference section, the outermost circumference section, and the central section based on the cooling equipment delivery-side temperature target value set for each of the innermost circumference section, the outermost circumference section, and the central section.

8. The system according to claim 3, wherein the set-up calculation device is further configured to:

change the cooling equipment delivery-side temperature target value to a low temperature when the flow amount set-up value in the edge section of the width direction is less than a lower limit.

9. The system according to claim 1, wherein the feedforward control device is configured to:

change the flow amount standard value to zero based on an emergency instruction that notifies an occurrence of an abnormality in the finisher mill and a facility downstream of the finisher mill.

10. A method for controlling the temperature of a material to be rolled in a hot rolling line, the hot rolling line including a rougher mill for performing a reverse rolling, a finisher mill for performing a tandem rolling, an intermediate equipment group provided between the rougher mill and the finisher mill, a rougher delivery-side pyrometer provided between the rougher mill and the intermediate equipment group, a finisher entry-side pyrometer provided between the finisher mill and the intermediate equipment group, and a control device, wherein the intermediate equipment group includes a cooling equipment for cooling the material to be rolled using coolant water, wherein the method comprising the steps of:

determining a flow amount set-up value of the coolant water in the cooling equipment; performing feedforward control of a flow amount of the coolant water in the cooling equipment based on the flow amount set-up value; and calculating a learning value based on a flow amount measured value of the coolant water in the cooling equipment and a finisher entry-side temperature measured value indicating a measured value of temperature of the material to be rolled measured by the finisher entry-side pyrometer, wherein the step of determining the flow amount set-up value comprises the steps of:

determining a finisher entry-side temperature target value indicating a target value of the temperature of the material to be rolled at an entry side of the finisher mill before a final pass of the reverse rolling on the material to be rolled is performed;

calculating a cooling equipment delivery-side temperature target value indicating a target value of the temperature of the material to be rolled at a delivery side of the cooling equipment for a finisher entry-side temperature prediction value indicating a predicted value of the temperature of the material to be rolled at the entry side of the finisher mill to match the finisher entry-side temperature target value; and determining the flow amount set-up value based on the cooling equipment delivery-side temperature target value and the learning value, wherein the step of performing the feedforward control comprises the steps of:

determining a target temperature pattern indicating a pattern of target values of the temperature of the material to be rolled over entire length of the material to be rolled at the delivery side of the cooling equipment;

calculating flow amount standard values of the coolant water in the cooling equipment for each point in a longitudinal direction of the material to be rolled based on the flow amount set-up value, velocity information of the rougher mill, and a rougher delivery-side temperature measured value indicating a measured value of the temperature of the material to be rolled measured by the rougher delivery-side pyrometer, wherein the flow amount standard values are calculated such that a cooling equipment delivery-side temperature prediction value indicating a predicted value of the temperature of the material to be rolled at the delivery side of the cooling equipment is consistent with the target temperature pattern; and performing the feedforward control such that flow amounts of the coolant water in the cooling equipment when each point of the material to be rolled reaches position to be cooled by the cooling equipment are respectively consistent with the flow amount standard values calculated for each point of the material to be rolled, wherein the step of calculating the learning value comprises the steps of:

calculating the learning value based on a difference between the finisher entry-side temperature measured value and a finisher entry-side temperature re-prediction value indicating a re-prediction value of a temperature of the material to be rolled at the entry side of the finisher mill, wherein the finisher entry-side temperature re-prediction value is calculated based on the flow amount measured value, the rougher delivery-side temperature measured value, and an actual velocity of the material to be rolled.

* * * * *